US007128014B2

(12) United States Patent
Berthiaume et al.

(10) Patent No.: US 7,128,014 B2
(45) Date of Patent: Oct. 31, 2006

(54) WATERCRAFT COMPENSATION SYSTEM

(75) Inventors: Yves Berthiaume, Mont St-Hilaire (CA); Sam Spade, Palm Bay, FL (US)

(73) Assignee: Bombardier Recreational Products, Inc., Valcourt (CA)

( * ) Notice: Subject to any disclaimer, the term of this patent is extended or adjusted under 35 U.S.C. 154(b) by 0 days.

(21) Appl. No.: 10/634,913

(22) Filed: Aug. 6, 2003

(65) Prior Publication Data

US 2004/0029459 A1 Feb. 12, 2004

Related U.S. Application Data

(60) Provisional application No. 60/401,013, filed on Aug. 6, 2002.

(51) Int. Cl.
*B63B 21/04* (2006.01)

(52) U.S. Cl. ..... 114/253

(58) Field of Classification Search ..... 114/144 B, 114/253, 285, 144 R; 440/1, 84
See application file for complete search history.

(56) References Cited

U.S. PATENT DOCUMENTS 3,105,387 A * 10/1963 Hayes ..... 114/144 B
5,110,310 A * 5/1992 Hobbs ..... 440/1
5,167,550 A * 12/1992 Nielsen ..... 440/84
5,351,387 A * 10/1994 Iwata et al. ..... 29/602.1
5,385,110 A * 1/1995 Bennett et al. ..... 114/285
6,016,286 A * 1/2000 Olivier et al. ..... 367/17
6,308,649 B1 * 10/2001 Gedeon ..... 114/39.11
6,583,728 B1 * 6/2003 Staerzl ..... 340/686.1

* cited by examiner

*Primary Examiner*—Stephen Avila
(74) *Attorney, Agent, or Firm*—Osler, Hoskin & Harcourt LLP

(57) ABSTRACT

A watercraft is disclosed that includes a hull, a deck supported by the hull, a propulsion system that is mounted to at least one of the hull and the deck, and a helm that is connected to the deck and configured to control the direction of the watercraft. A pole is mounted to the deck and a compensation device is operatively connected to at least one of the deck and the hull. A controller is in communication with the compensation device, and a sensor is operatively connected to the pole and in communication with the controller. The sensor is configured to sense a pulling force exerted on the pole and communicate a signal regarding the force to the controller. The controller is configured to send a signal to the compensation device based on the signal from the sensor to reposition the watercraft.

30 Claims, 23 Drawing Sheets

WATERCRAFT COMPENSATION SYSTEM

CROSS-REFERENCE TO RELATED APPLICATIONS

This application claims the benefit of priority to U.S. Provisional Application No. 60/401,013, titled "WATERCRAFT COMPENSATION SYSTEM," filed Aug. 6, 2002, which is incorporated by reference herein in its entirety.

BACKGROUND OF THE INVENTION

1. Field of the Invention

This invention relates to a personal watercraft ("PWC"), and more particularly to a compensation system for a PWC that is configured to pull a load behind it.

2. Description of Related Art

Watercraft are generally defined by three axes, including the roll axis, the pitch axis, and the yaw axis. The roll axis is oriented along the longitudinal centerline of the watercraft and is substantially horizontal. The pitch axis is also substantially horizontal and is perpendicular to the roll axis. The yaw axis is perpendicular to the roll axis and the pitch axis and is substantially vertical.

Rotation about the roll axis gives the rider of the watercraft a feeling that the watercraft is rocking side to side as if the watercraft is parallel to a passing wave. Rotation about the pitch axis causes the bow of the watercraft to rise out of the water and the stern to sink into the water and vice-versa. Rotation about the yaw axis causes the watercraft to twist relative to vertical, which gives the rider a sense that the watercraft is "fish tailing."

Jet powered watercraft have become very popular in recent years for recreational use and for use as transportation in coastal communities. Because of the performance that jet power offers, PWCs and sport boats are often used to pull loads, including but not limited to water skiers and wakeboarders. The loads being pulled exert a pulling force on the watercraft. Such a pulling force, however, may cause the watercraft to rotate about any one of the three axes.

Further, because of their compact size, PWCs are more sensitive to such changes along and about their axes. Although the operator of the PWC can compensate for some of the moments, and hence rotations, generated by the location and the movement of the load by counter-steering and altering speed, there is a need for a more automated compensation system such that the level of compensation directed by the operator is reduced.

SUMMARY OF THE INVENTION

Therefore, one aspect of embodiments of this invention provides a compensation system for a PWC that alters at least one performance parameter of the PWC without input from the operator. The performance parameters of the PWC include, but are not limited to speed, steering heading, rotation about the roll axis, rotation about the pitch axis, and rotation about the yaw axis.

The invention is directed to a watercraft that includes a hull having port and starboard sides and a stern, a deck supported by the hull and a propulsion system that is mounted to at least one of the hull and the deck. A helm is connected to the deck and configured to control the direction of the watercraft. A pole is mounted to the deck and a compensation device operatively connected to at least one of the deck and the hull. A controller is in communication with the compensation device, and a sensor is operatively connected to the pole and in communication with the controller. The sensor is configured to sense a pulling force exerted on the pole and communicate a signal regarding the force to the controller. The controller is configured to send a signal to the compensation device based on the signal from the sensor to reposition the watercraft.

The invention is also directed to a watercraft that includes a hull having port and starboard sides and a stern, a deck supported by the hull, a propulsion system mounted to at least one of the hull and the deck, and a helm connected to the deck and configured to control the direction of the watercraft. A pole is mounted to the deck and at least a portion of the pole is rotatable about the longitudinal axis of the pole. A compensation device is operatively connected to the pole. The compensation device is actuated to reposition the watercraft when the pole rotates.

The invention is also directed to a method for compensating for a pulling force being exerted on a pole mounted on a watercraft that includes sensing a pulling force exerted on the watercraft, and altering at least one performance parameter of the watercraft based on the sensed force.

The invention is also directed to a tow pole for a watercraft configured to connect to a tow rope. The tow pole includes a shaft, a tow rope receiving portion that is connected to the shaft, and a sensor. The sensor is positioned to sense tension in the tow rope.

The invention is also directed to a tow pole that includes a shaft having at least a portion that is rotatable about the longitudinal axis of the shaft, a tow rope receiving portion that is connected to the shaft and a sensor. The sensor is positioned to sense rotation of the rotatable portion of the shaft.

The invention is also directed to a watercraft including a hull having port and starboard sides and a stern, a deck supported by the hull, a straddle seat for an operator that is supported by the deck, and a grab handle that is connected to at least one of the seat and the deck. A propulsion system is mounted to at least one of the hull and the deck. A helm that includes a handle bar is connected to the deck forward of the straddle seat and is configured to control the direction of the watercraft. A compensation device is operatively connected to at least one of the deck and the hull and a controller is in communication with the compensation device. A sensor is in communication with the controller and is configured to sense a pulling force and communicate a signal regarding the force to the controller. The controller is configured to send a signal to the compensation device based on the signal from the sensor to reposition the watercraft.

These and other aspects of embodiments of the invention will become apparent when taken in conjunction with the following detailed description and drawings.

BRIEF DESCRIPTION OF THE DRAWINGS

An understanding of the various embodiments of the invention may be gained by virtue of the following Figures, of which like elements in various Figures will have common reference numbers, and wherein.

DETAILED DESCRIPTION OF PREFERRED EMBODIMENTS

The invention is described with reference to a PWC for purposes of illustration only. However, it is to be understood that the steering and handling systems described herein can be utilized in any watercraft, particularly those crafts that are powered by jet propulsion engines, such as sport boats, and are configured to pull a load, such a water skier, wakeboarder, tube, another watercraft, or the like.

Figure 1:
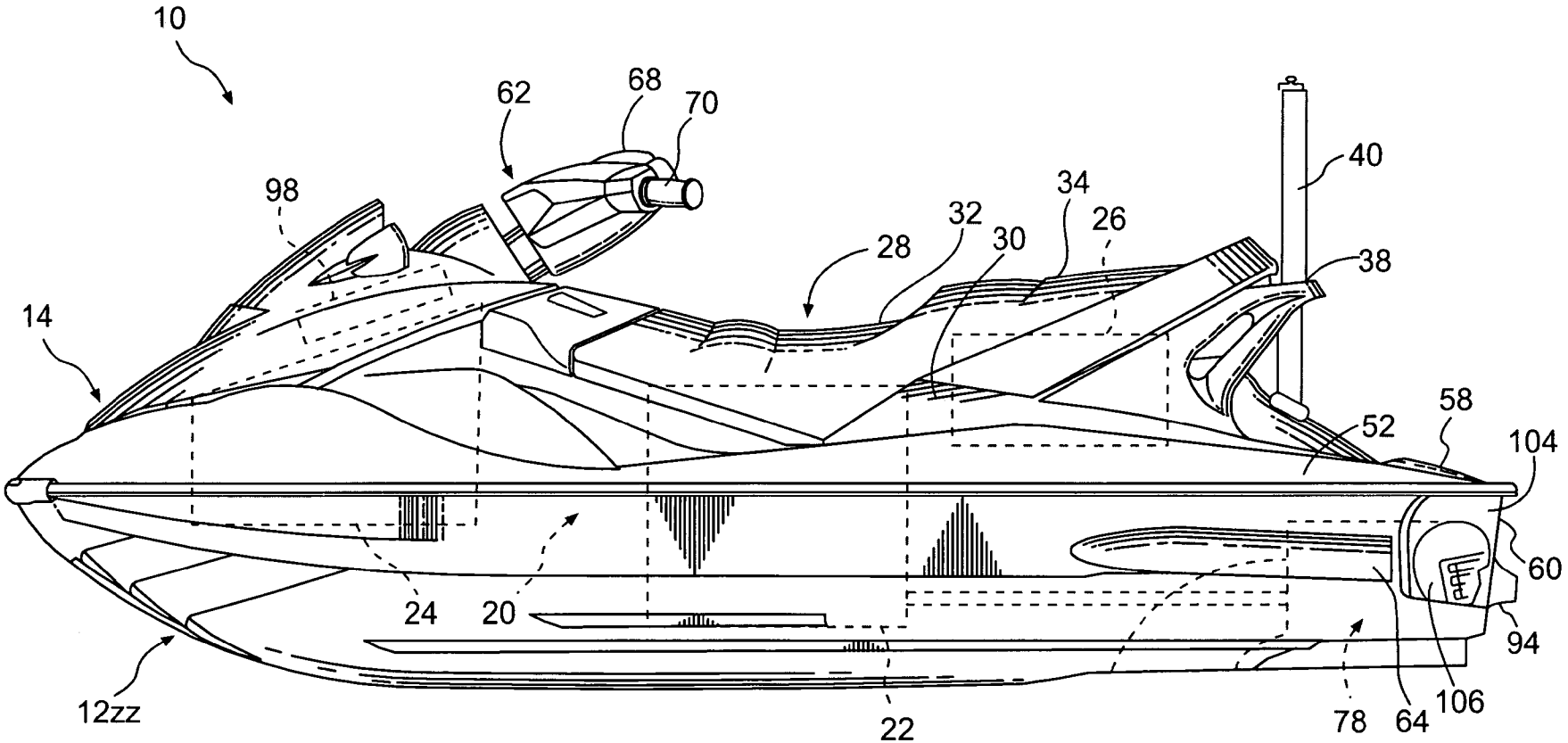
FIG. 1 illustrates a side view of a watercraft in accordance with the preferred embodiment of the invention.

FIG. 1 is a side view of a PWC 10 in accordance with a preferred embodiment of the present invention. The following description relates to one way of manufacturing a PWC according to a preferred design. Obviously, those of ordinary skill in the watercraft art will recognize that there are other known ways of manufacturing and designing watercraft and that this invention would encompass other known ways and designs.

The PWC 10 of FIG. 1 is made of two main parts, including a hull 12 and a deck 14 that are integrally joined together. The hull 12 buoyantly supports the PWC 10 in the water. The deck 14 is designed to accommodate a rider and, in some PWC, one or more passengers.

The space between the hull 12 and the deck 14 forms a volume commonly referred to as the engine compartment 20 (shown in phantom). Shown schematically in FIG. 1, the engine compartment 20 accommodates an engine 22, as well as a muffler, tuning pipe, gas tank, electrical system (battery, electronic control unit, etc.), air box, storage bins 24, 26, and other elements required or desirable in the PWC 10.

Figure 2:
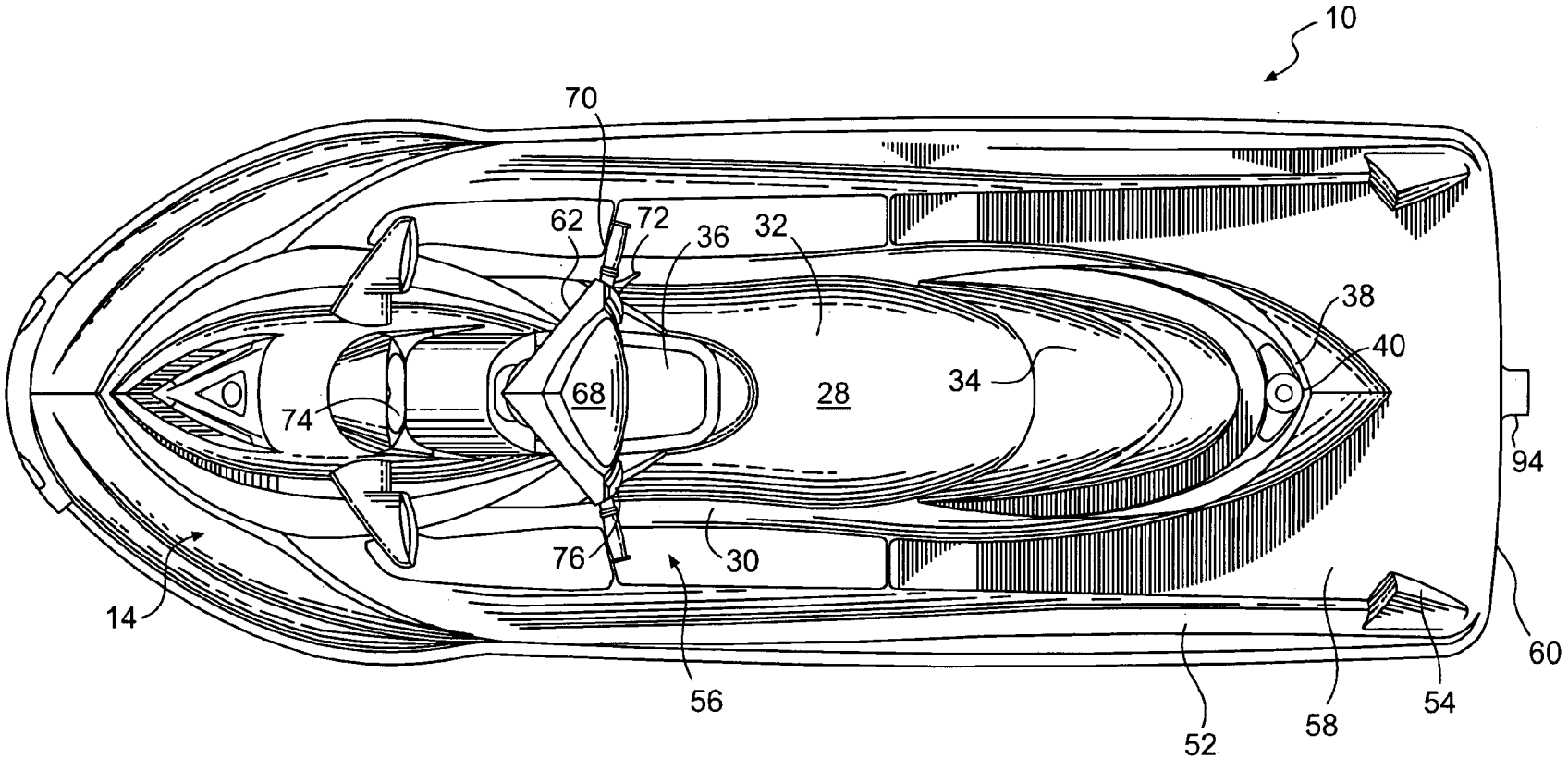
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 may be sized to accommodate a single rider or sized for multiple riders. For example, as seen in FIG. 2, the seat 28 includes a first, front seat portion 32 and a rear, raised seat portion 34 that accommodates a passenger. The seat portions 32, 34 can be individually tilted or removed completely. One of the seat portions 32, 34 covers an engine access opening (in this case above engine 22), defined by a top portion of the pedestal 30, to provide access to the engine 22 (FIG. 1). The other seat portion (in this case portion 34) can cover a removable storage box 26 (FIG. 1). A small storage box 36 (FIG. 2) may also be provided in front of the seat 28.

Figure 3:
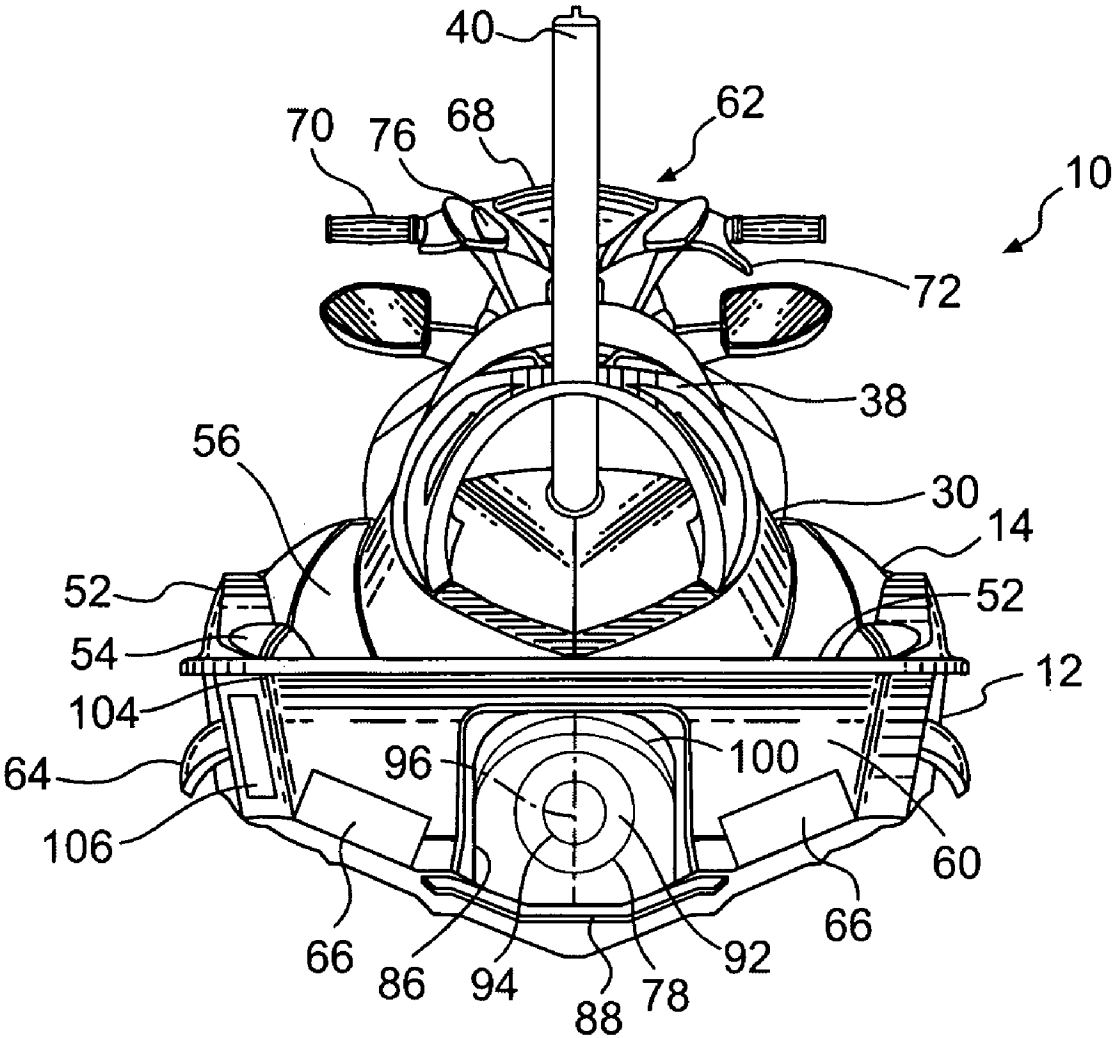
FIG. 3 is a back view of the watercraft of FIG. 1.

As seen in FIG. 3, a grab handle 38 may be provided between the pedestal 30 and the rear of the seat 28 to provide a handle onto which a passenger may hold. This arrangement is particularly convenient for a passenger seated facing backwards for spotting a water skier, for example. Beneath the handle 38, a tow pole 40, also commonly referred to as a pylon, is mounted on the deck 14, more specifically on the pedestal 30 or a reboarding platform 58, such that it extends through the handle 38 and above the level of the seat 28. Alternatively, the tow pole 40 may not extend through the handle 38, but may instead be mounted such that it extends from the deck 14 rearward of the handle 38. The tow pole 40 may be telescopic so that it can be stored in a non-extended position. Also, the tow pole 40 may include handles (not shown) onto which a passenger may hold when the passenger is facing backwards. The tow pole 40 can be used for towing a skier or floatation device, such as an inflatable water toy, and is described in further detail below.

As best seen in FIGS. 2 and 3 the PWC 10 has a pair of generally upwardly extending walls known as gunwales or gunnels 52 located on either side of the PWC 10. Towards the rear of the PWC 10, the gunnels 52 extend inwardly to act as heel rests 54, which support a passenger's feet when the passenger is riding the PWC 10 facing towards the rear, to spot a water skier for example. Located on both sides of the PWC 10, between the pedestal 30 and the gunnels 52 are footrests 56, which accommodate a rider's feet in various riding positions.

The reboarding platform 58 is provided at the rear of the PWC 10 on the deck 14 to allow the rider or a passenger to easily reboard the PWC 10 from the water. Carpeting or some other suitable covering may cover the reboarding platform 58. A retractable ladder (not shown) may be affixed to a stern 60 to facilitate boarding the PWC 10 from the water onto the reboarding platform 58.

Sponsons 64 are located on both sides of the hull 12 near the stern 60. The sponsons 64 preferably have an arcuate undersurface that gives the PWC 10 both lift while in motion and improved turning characteristics. The sponsons 64 are preferably fixed to the surface of the hull 12 and can be attached to the hull by fasteners or molded therewith. Sometimes it may be desirable to adjust the position of the sponsons 64 with respect to the hull 12 to change the handling characteristics of the PWC 10 and accommodate different riding conditions. Trim tabs 66, which are commonly known, may also be provided at the stern 60 and may be controlled from a helm assembly 62, which is positioned forwardly of the seat 28, as shown in FIGS. 1 and 2.

The helm assembly 62 has a central helm portion 68, that may be padded, and a pair of steering handles 70, also referred to as a handle bar. Of course, any type of steering mechanism can be used. One of the steering handles 70 is preferably provided with a throttle lever 72, which allows the rider to control the speed of the PWC 10. As seen in FIG. 2, a display area or cluster 74 is located forwardly of the helm assembly 62. The display cluster 74 can be of any conventional display type, including a liquid crystal display (LCD), dials or LED (light emitting diodes). The central helm portion 68 may also have various buttons 76, which could alternatively be in the form of levers or switches, that allow the rider to modify the display data or mode (speed, engine rpm, time . . . ) on the display cluster 74 or to change a condition of the PWC 10, such as trim (the pitch of the PWC).

As shown in FIGS. 1 and 3, the PWC 10 is generally propelled by a jet propulsion system 78 or jet pump. As known, the jet propulsion system 78 pressurizes water to create thrust. The jet propulsion system 78 is located in a formation in the hull 12, referred to as a tunnel 86. The tunnel 86 is defined at the front, sides, and top by the hull 12 and is open at the stern 60. The bottom of the tunnel 86 is closed by a ride plate 88. The ride plate 88 creates a surface on which the PWC 10 rides or planes at high speeds.

Once the water leaves the jet propulsion system 78, it goes through a venturi 92. Since the venturi's exit diameter is smaller than its entrance diameter, the water is accelerated further, thereby providing more thrust. A steering nozzle 94 is pivotally attached to the venturi 92 so as to rotate about a vertical axis 96. The steering nozzle 94 could also be supported at the exit of the tunnel 86 in other ways without a direct connection to the venturi 92. Moreover, the steering nozzle 94 can be replaced by a rudder or other diverting mechanism disposed at the exit of the tunnel 86 to selectively direct the thrust generated by the jet propulsion system 78 to effect turning.

The steering nozzle 94 is operatively connected to the helm assembly 62 preferably via a push-pull cable (not shown) such that when the helm assembly 62 is turned, the steering nozzle 94 pivots. This movement redirects the pressurized water coming from the venturi 92, so as to redirect the thrust and steer the PWC 10 in the desired direction. Optionally, the steering nozzle 94 may be gimbaled to allow it to move around a second horizontal pivot axis (not shown). The up and down movement of the steering nozzle 94 provided by this additional pivot axis is known as trim and controls the pitch of the PWC 10.

When the PWC 10 is moving, its speed is measured by a speed sensor (not shown) that is typically attached to the stern 60 of the PWC 10. The speed sensor has a paddle wheel (not shown) that is turned by the water flowing past the hull. In operation, as the PWC 10 goes faster, the paddle wheel turns faster in correspondence. An electronic control unit 98, also commonly referred to as a controller and shown in phantom, is connected to the speed sensor and converts the rotational speed of the paddle wheel to the speed of the PWC 10 in kilometers or miles per hour, depending on the rider's preference. The speed sensor may also be placed in the ride plate 88 or at any other suitable position. Other types of speed sensors, such as pitot tubes, and processing units could be used, as would be readily recognized by one of ordinary skill in the art.

The PWC 10 may be provided with the ability to move in a reverse direction. With this option, a reverse gate 100, seen in FIG. 3, is used. The reverse gate 100 is pivotally attached to the sidewalls of the tunnel 86 or directly on the venturi 92 or the steering nozzle 94.

Referring again to FIGS. 1 and 3, a depression 104 is formed on each side of the hull 12 at the stern 60 of the PWC 10. The depression 104 forms a recess in each side of the hull 12. A pair of side vanes 106 is attached to each side of the hull 12 in the depressions 104. As the vanes on each side are mirror images of each other, only one vane is described herein for purposes of simplicity. The term "vane" is intended to be a generic term to describe a flap, rudder, or other type of mechanism that can be operated to divert the flow of water and thus assist in turning a PWC. The side vanes 106 are preferably triggered by the helm 62 and can be activated in response to the pressure generated within the jet propulsion system 78. The side vanes 106 are described in detail in commonly owned U.S. Pat. No. 6,523,489 and commonly owned and currently pending application Ser. No. 10/195,324, filed on Jul. 16, 2002 and published in Patent Publication No. 2003/0019411A1 on Jan. 30, 2003, the contents of which are both herein incorporated into this application in their entirety by reference.

The compensation system in accordance with this invention is now described in detail. In general, the invention is directed to the tow pole 40, various sensor configurations to sense whether a pulling force is being exerted on the PWC 10, the controller 98, and at least one compensation device. The controller 98 is configured to communicate with different sensors and is configured to send a signal to at least one compensation device so as to alter at least one performance parameter of the PWC 10.

The performance parameters of the PWC 10 include, but are not limited to, the speed of the PWC 10, the steering heading of the PWC 10, and the PWC's rotation about the pitch axis, the roll axis, and the yaw axis. The compensation devices of the PWC 10 include the trim tabs 66, the vanes 106, a device to alter the center of gravity of the PWC 10 (discussed in detail below), the nozzle 94, and the throttle. As described below, there are many embodiments of the tow pole and many embodiments of the sensor that senses the pulling force. It is understood that different combinations of the tow pole and the sensor are within the spirit of the invention and the description below should not be construed as limiting in any way.

Figure 4:
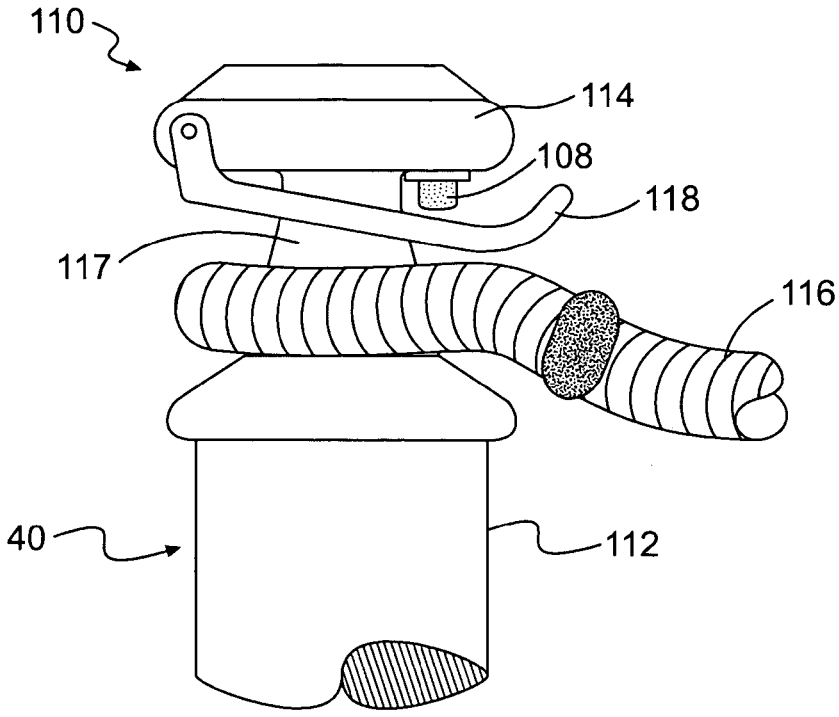
FIG. 4 is an enlarged partial side view of a tow pole of the watercraft when no pulling force is being exerted on the watercraft.
Figure 5:
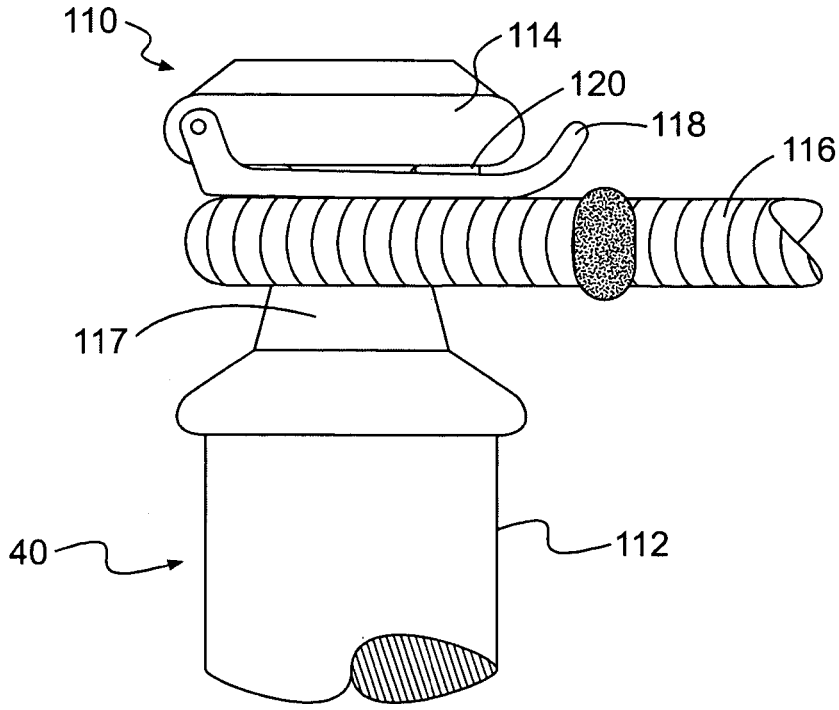
FIG. 5 is an enlarged partial side view of the tow pole of FIG. 4 when a pulling force is being exerted on the watercraft.

As described above, the tow pole 40 is mounted to the deck 14 and is configured to tow a skier or floatation device. In one embodiment, shown in FIGS. 4 and 5, the tow pole 40 includes a top portion 110 that is disposed at the end of a shaft 112. In this embodiment, the top portion 110 includes a body 114 that is shaped in a spool-like configuration so that a tow rope 116 can be looped around the top portion 110 and remain thereon, even when there is no tension in the rope 116. As illustrated in FIGS. 4 and 5, the body 114 includes a central portion 117 that is substantially conical in shape such that that central portion 117 is wider at the bottom and narrower at the top. The top portion 110 may also include a lever 118 that is pivotally connected to the body 114. As shown in FIG. 4, the lever 118 rests in a downward position when there is no tension in the rope 116. When there is tension in the rope 116, the shape of the central portion 117 causes the rope 116 to move upward, thereby causing the lever 118 to move upward, as shown in FIG. 5. The top portion 110 of the tow pole 40 also includes a sensor 108 that is disposed on the body 114. The sensor 108 is in communication with the controller 98. The sensor 108 maybe of any known type, including but not limited to an electrical switch-like sensor that makes contact with a circuit when actuated in an "on" position. Other types of sensors, including but not limited to optical, mechanical or piezoelectric, can be used. It is understood that FIGS. 4 and 5 illustrate only one embodiment of the tow pole 40 and the sensor 108 and that alternative embodiments are contemplated that are within the scope of the invention, but not illustrated.

Figure 6:
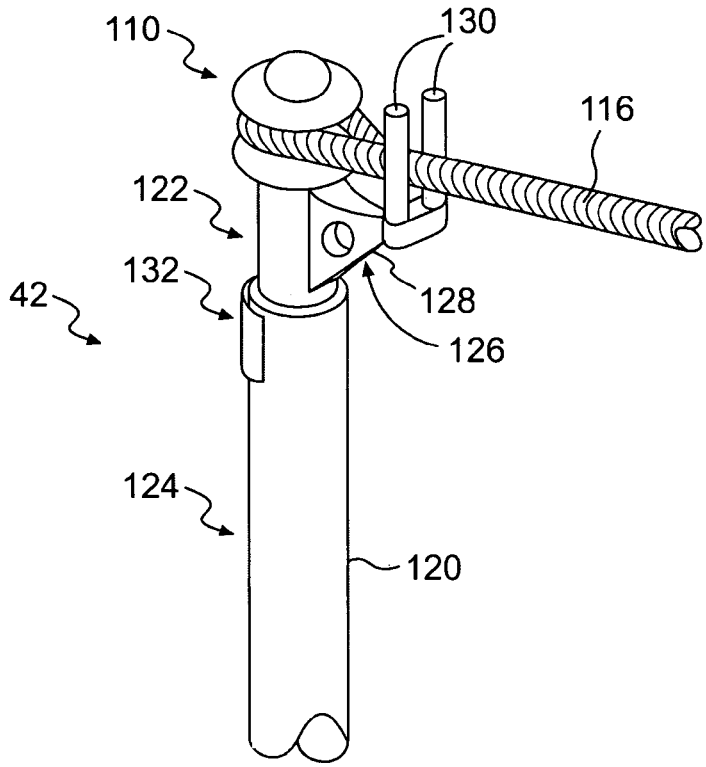
FIG. 6 a partial perspective view of an alternative tow pole of the watercraft.
Figure 7:
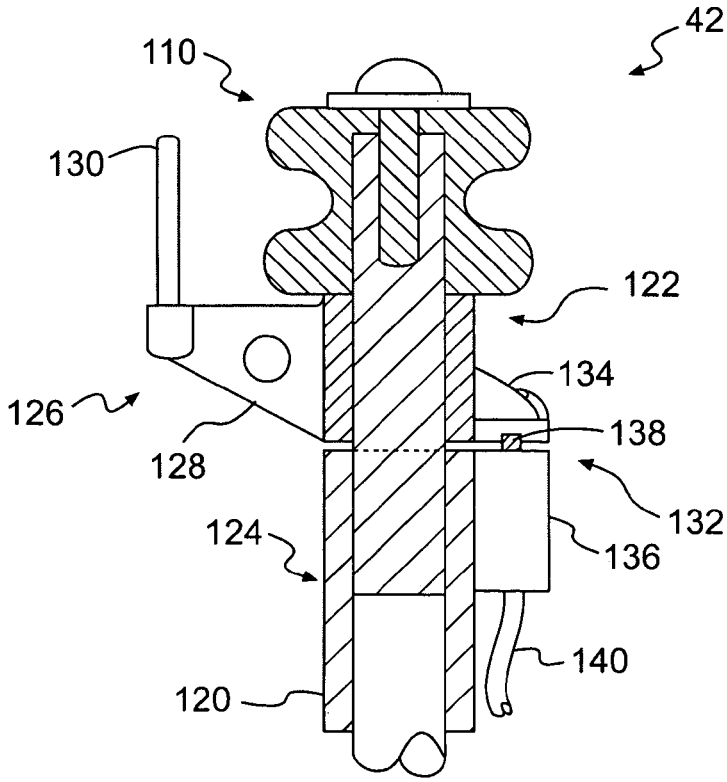
FIG. 7 is a partial cross-sectional view of the tow pole of FIG. 6 without a tow rope.

FIGS. 6 and 7 illustrate another embodiment of a tow pole 42 in which an upper portion 122 of a shaft 120 is rotatably mounted to a lower portion 124 of the shaft 120. As shown in FIG. 6, a rope guide 126 is disposed on the upper portion 122 of the shaft 120 in an orientation that faces substantially towards the stern of the PWC. The rope guide 126 includes a mounting bracket 128 that is attached to the upper portion 122 of the shaft 120. A pair of guide posts 130 are mounted to the mounting bracket 128 by conventional means such that the guide posts 130 are rigidly fixed to the mounting bracket 128 in a substantially vertical orientation. As shown in FIG. 7, a sensor housing 132 is disposed on an opposite side of the shaft 120 from the mounting bracket 128. In the illustrated embodiments, the sensor housing 132 includes two portions: an upper portion 134 and a lower portion 136 that are movable with respect to each other. The upper portion 134 is disposed on the upper portion 122 of the shaft 120 and the lower portion 136 is disposed on the lower portion 124 of the shaft 120. A sensor 138 is disposed at the interface between the upper portion 134 and the lower portion 136 of the sensor housing 132.

The sensor 138 illustrated in FIG. 7 may be of any known type, including but not limited to a micro-switch that is engaged when the upper portion 134 and the lower portion 136 of the sensor housing 132 are aligned, indicating that any force being exerted on the PWC 10 through the rope 116 is directly behind the PWC 10. When the force being exerted on the PWC moves towards the starboard or port side of the PWC 10, the rope 116 will contact one of the guide posts 130 and cause the upper portion 122 of the shaft 120 to rotate relative to the bottom portion 124. This will cause the micro-switch 138 to release and send a signal to the controller 98 through a wire 140 connected to the lower portion 136 of the sensor housing 132. Additional switches (not shown) may be positioned on opposite sides of the sensor 138 to determine the direction and degree of rotation of the upper portion 122 of the shaft 120 relative to the bottom portion 124. As discussed below, the controller 98 may use the signal from the sensor 138, and any additional switches, to cause at least one performance parameter, as described above, to change.

Figure 8:
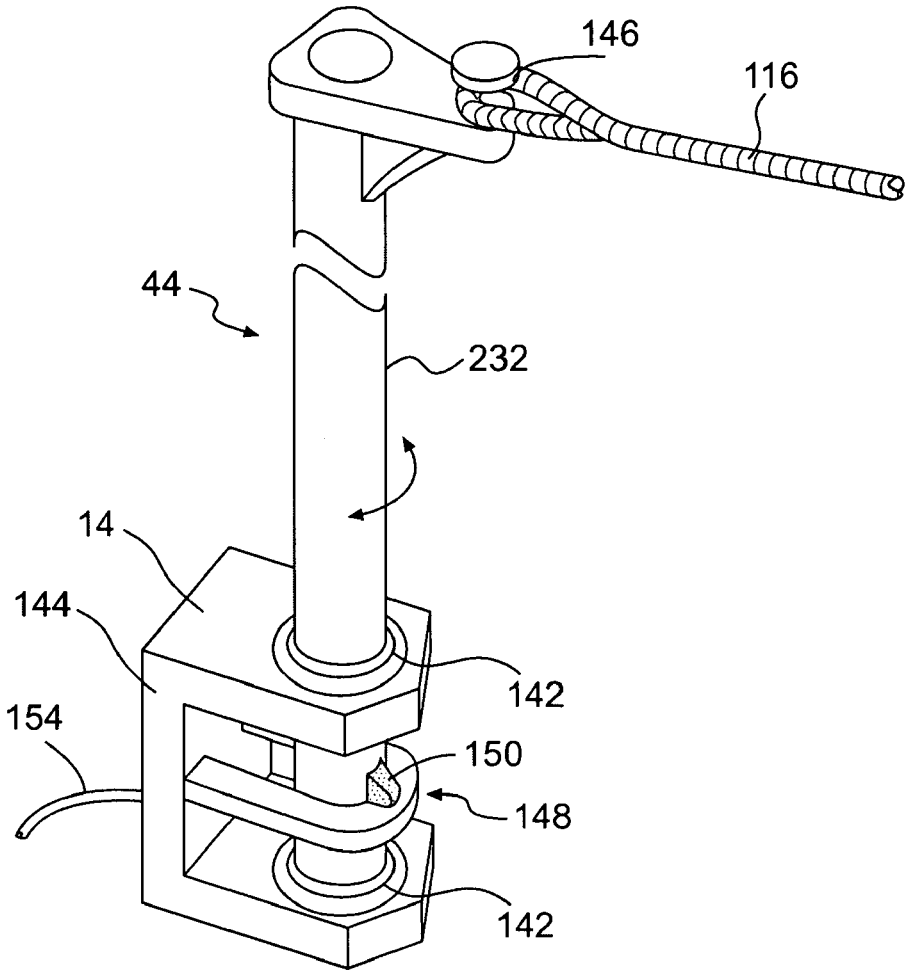
FIG. 8 is a perspective view of an alternative tow pole of the watercraft.

In another embodiment, as shown in FIG. 8, a tow pole 44 is rotatably mounted to the deck 14 of the PWC 10. In this embodiment, the shaft 232 is mounted to the PWC 10 with at least one bearing 142 and a bracket 144. The bracket 144 is attached to at least the deck 14 and may extend to the hull 12 such that the top of the bracket 144 is mounted to the deck 14 and the bottom of the bracket 144 is mounted to the hull 12. A shaft 232 is rotatably mounted to the bracket 144 with the at least one bearing 142. The bearing 142 is preferably press-fit to the shaft 232 by conventional methods and attached to the bracket 144 by conventional methods such that any rotation of the pole 44 will not cause the bracket 144 to twist. A tow rope hook 146 is disposed at the top of the shaft 232 and is configured to receive a loop at the end of the tow rope 116. Any change in the direction of the force exerted on the PWC 10 by the tow rope 116 will cause the pole 44 to rotate.

Figure 9:
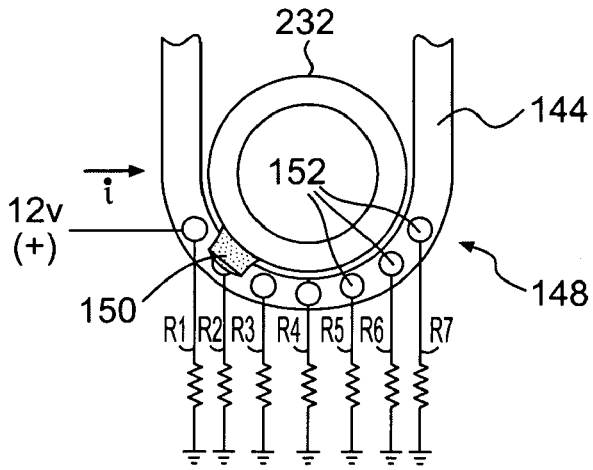
FIG. 9 is a schematic of a plurality of Reed switches disposed adjacent to the tow pole of FIG. 8.

As shown generally in FIG. 8 and in detail in FIG. 9, disposed between the bearings 142 within the bracket 144 is a sensor 148. As shown, the sensor 148 generally includes two portions. A permanent magnet 150 is attached to the shaft 232 of the tow pole 44 and a plurality of Reed switches 152 are mounted to the bracket 144. The Reed switches 152 are disposed on the bracket 144 in a horseshoe-like pattern. The switches 152 are essentially resistors of different resistance such that when the magnet 150 passes over an individual switch 152 as the pole 44 rotates, the switch 152 closes and communicates the corresponding current to the controller 98 through a communications line 154, thereby indicating the orientation of the pole 44, which indicates the direction of the force being exerted on the PWC 10.

Figure 10:
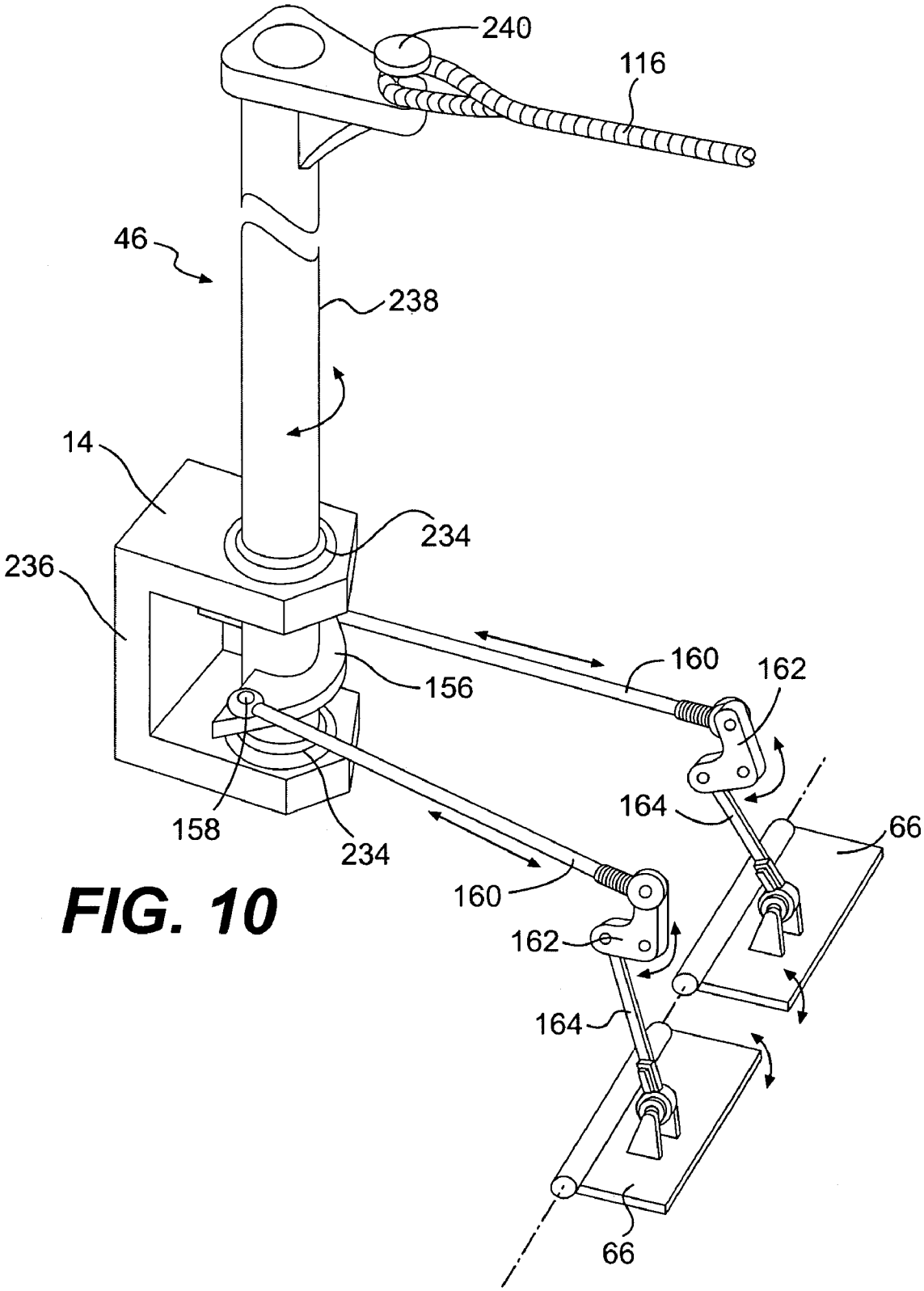
FIG. 10 is a top perspective view of the tow pole connected to trim tabs of the watercraft.

Another embodiment of a tow pole 46 is shown in FIG. 10. Similar to the embodiment illustrated in FIG. 8, the tow pole 46 is rotatably mounted to the deck 14 with a pair of bearings 234 and a bracket 236. Disposed between the pair of bearings 236 is a collar 156 that is fixedly attached to a shaft 238 of the tow pole 46 such that as the pole 46 rotates, the collar 156 rotates. The collar 156 includes a pair of connection points 158 that are disposed on opposite sides of the collar 156 relative to the shaft 112 such that when a tow hook 240 is aligned on the longitudinal axis of the PWC 10, the pair of connection points 158 are located substantially equidistantly from the stern 60 of the PWC 10, as shown in FIG. 10.

FIG. 10 also shows one embodiment of a compensation device. The compensation device shown in FIG. 10 includes the trim tabs 66 discussed previously. The trim tabs 66 are operatively connected to the collar 156 of the tow pole 46 with a first pair of actuating rods 160, a pair of elbows 162 and a second pair of actuating rods 164. The first pairs of actuating rods 160 are pivotally attached to the connection points 158 on the collar 156. The pairs of elbows 162, as shown in FIG. 10, are pivotally attached to the first pairs of actuating rods 160 and the second pair of actuating rods 164, which are pivotally attached to the trim tabs 66.

In operation, as the tow pole 46 turns because of a change in direction of the force exerted on the PWC 10, the actuating rods 160, 164 and elbows 162 will cause the trim tabs 66 to actuate upwardly and downwardly, depending on the direction of the force and, hence, the location of the tow hook 146. Because the connection points 158 on the collar 156 are disposed on opposite sides of the pole 46, the trim tabs 66 will actuate in opposite directions as the pole 46 turns. As the direction of the force being exerted on the PWC 10 moves to the starboard side of the PWC 10, the starboard trim tab 66 will move downward as the port trim tab 66 moves upward, and vice-versa. Such actuation of the trim tabs 66 will alter the rotation of the PWC 10 about the roll axis, especially when a skier is making hard cuts, and will also alter the rotation of the PWC 10 about the pitch axis.

Figure 11:
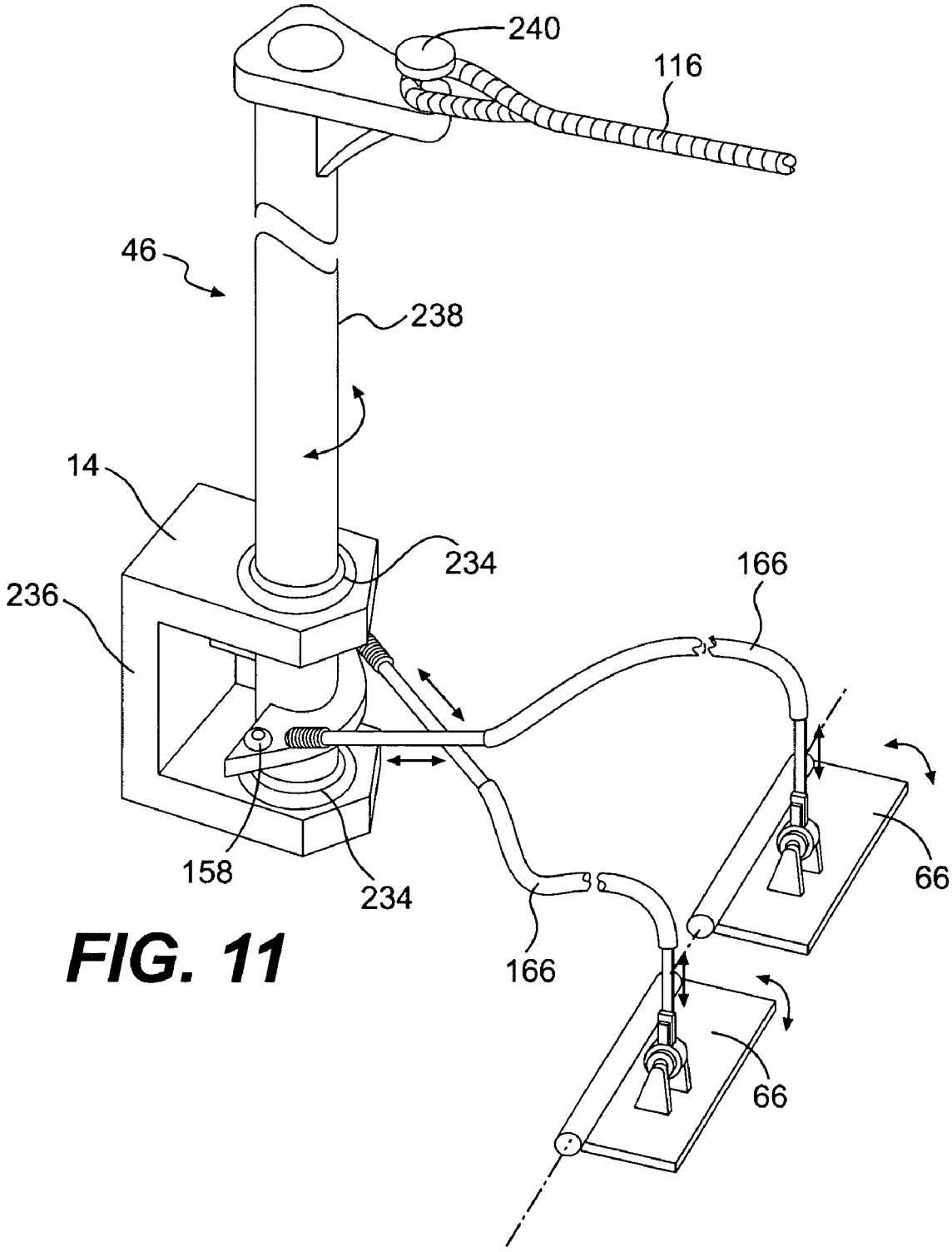
FIG. 11 is a top perspective view of the tow pole connected to trim tabs in an alternative configuration.

FIG. 11 illustrates an alternative to the embodiment shown in FIG. 10. As illustrated in FIG. 11, instead of utilizing actuating rods 160, 164 and elbows 162, a pair of push-pull cables 166 are operatively connected to the connection points 158 of the collar 156 at one end and are operatively connected to the trim tabs 66 at the opposite end.

The push-pull cables 166 function to actuate the trim tabs 66 in the same manner as the actuating rods 160, 164 and elbows 162.

Figure 12:
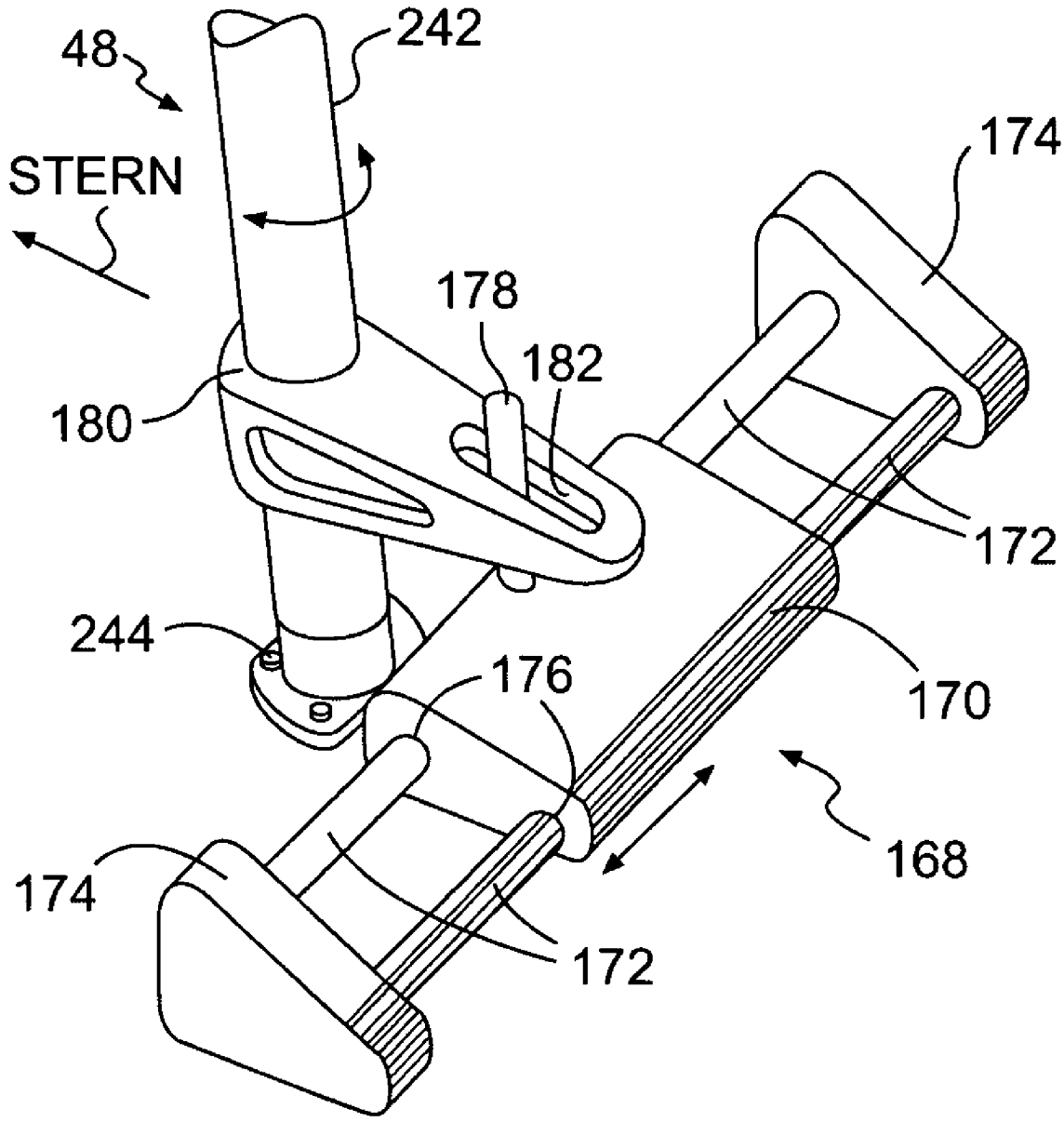
FIG. 12 is a top perspective view of a sliding weight compensation system of the watercraft.

In another embodiment, illustrated by FIG. 12, the compensation device includes a sliding weight system 168 that is operatively connected to a tow pole 48. As shown, the sliding weight system 168 includes a weight 170 that is supported by a pair of rods 172. Ends of the rods 172 are attached to a pair of supports 174 that are mounted to the deck 14 of the PWC 10 at a position forward of the pole 48. It is also possible to mount the weight system 168 on the bottom of the tow pole 48 beneath the deck within the hull 12.

The rods 172 are disposed such that they are substantially perpendicular to the longitudinal axis of the PWC 10 and extend from one support 174 to the other support 174. The weight 170 preferably includes holes 176 through which the rods 172 are disposed such that the weight 170 may slide along the length of the rods 172 in between the supports 174. The weight 170 also includes a post 178 that is fixedly attached to the weight 170 and extends upward in a substantially vertical direction. A bracket 180 is attached to a shaft 242 of the tow pole 48 and includes a slot 182 through which the post 178 extends. The shaft 242 is rotatably mounted to the deck 14 of the PWC 10 in a manner previously described, through the use of at least one bearing 244.

In operation, as the pole 48 rotates due to a change in the direction of the pulling force, the weight 170 slides along the rods 172 towards the side of the PWC 10 opposite the direction of the force. Thus, if a water skier cuts to the port side of the PWC 10, the pole 40 will rotate such that the weight 170 will slide towards the starboard side of the PWC 10 to compensate for the shift in the center of gravity of the PWC 10, thereby altering the rotation of the PWC 10 about the roll axis.

In addition to the embodiments of the tow pole illustrated in FIGS. 6–12, it is contemplated that the pole may be operatively connected to a sensor that is configured to sense when the force being exerted on the PWC 10 is applied from a direction beyond a predetermined position. For example, if it is desired to sense if a skier is positioned at an angle greater than 45°, in either direction, from the longitudinal axis of the PWC 10, a sensor may be located such that a signal may be sent to the controller 98 indicating that some type of compensation should take place to alter at least one performance parameter of the PWC 10.

Figure 13:
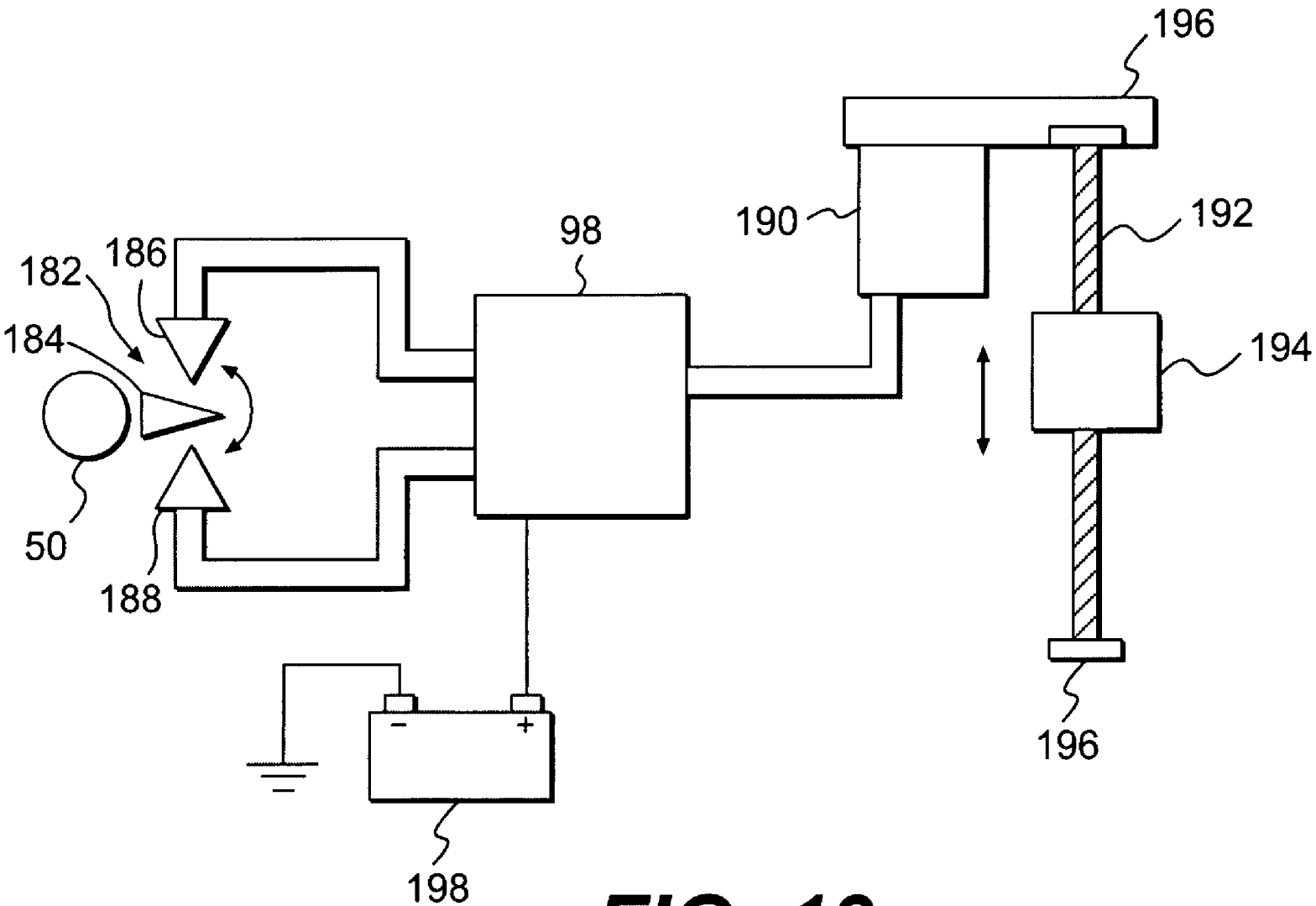
FIG. 13 is a schematic of an alternative sliding weight compensation system of the watercraft.

FIG. 13 illustrates an another embodiment of the compensation system illustrated in FIG. 12. In FIG. 13, the pole 50 includes a sensor 182 which includes an indicator 184 connected to the pole 40, a starboard switch 186, and a port switch 188. When the direction of the pulling force being exerted on the PWC 10 exceeds a predetermined angle relative to the longitudinal axis of the PWC 10, the indicator 184 will contact either the starboard switch 186 or the port switch 188, depending on the direction of the force. When either of the switches 186, 188 is contacted by the indicator 184, a signal will be sent to the controller 98. The controller 98 will then send a signal to a motor 190. The motor 190 will drive a screw 192 on which a weight 194 is disposed. The screw 192 is rotatably attached to the PWC 10 at opposite ends with bearings 196 and is disposed such that it is substantially perpendicular to the longitudinal axis of the PWC 10. As the motor 190 drives the screw to rotate about its own axis, the weight 194 will slide along the screw 192, thereby altering the center of gravity of the PWC 10. The embodiment illustrated in FIG. 13 further includes a battery 198 to provide power to the controller 98.

Figure 14:
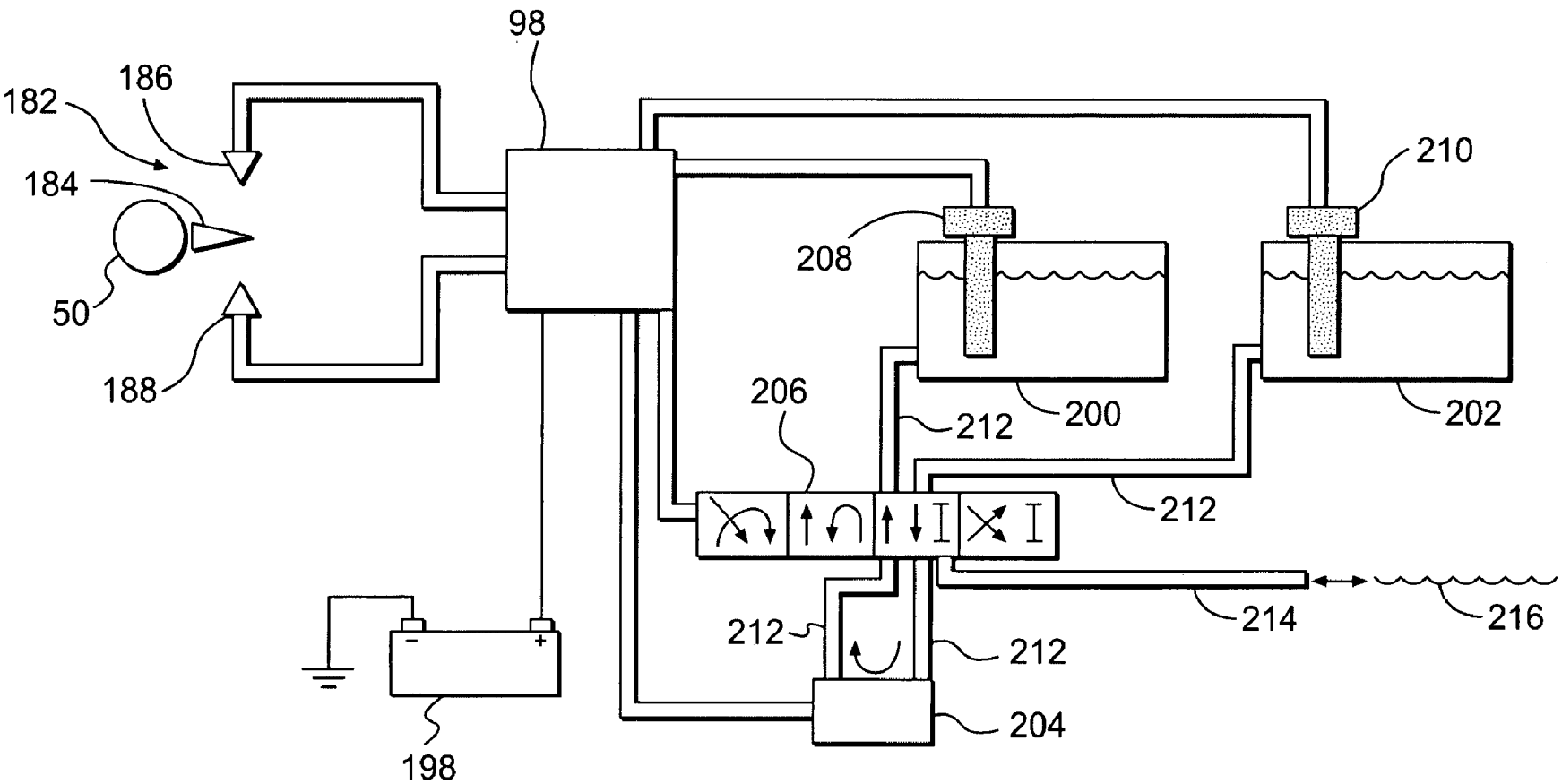
FIG. 14 is a schematic of a water ballast compensation system of the watercraft.

In another embodiment of the compensation system illustrated in FIG. 14, the PWC 10 further includes a port ballast tank 200 and a starboard ballast tank 202. A pump 204 and a valve 206 are in fluid communication with the ballast tanks 200, 202 through pipes or tubing 208. A port level sensor 210 is disposed such that it may detect the level of water in the port ballast tank 200 and a starboard level sensor 212 is disposed such that it may detect the level of water in the starboard ballast tank 202. The level sensors 210, 212 are in electrical communication with the controller 98. A length of pipe 214 is also in fluid communication with the valve 206 at one end and outside water 216 at the other end. The pole 50 with the same sensor 182 that is illustrated in FIG. 13 and described above is also shown in FIG. 14. In this embodiment, when either of the switches 186, 188 is activated, indicating that a skier is at or beyond a predetermined angle relative to the longitudinal axis of the PWC 10, a signal is sent to the controller 98. The level sensors 210, 212 also send signals to the controller 98 to indicate the current levels of their respective ballast tanks 200, 202.

Based on the signal inputs to the controller 98, the controller 98 then sends a signal to the valve 206 and the pump 208. The valve 206 includes a plurality of predetermined settings that allow for a plurality of water flow patterns. For example, if the controller 98 determines that the center of gravity must be shifted to the starboard side of the PWC 10 based a skier being on the port side of the PWC 10, the valve 206 may be positioned such that the pump 204 pumps water from the port ballast tank 200 to the starboard ballast tank 202. Alternatively, the controller 98 may signal the valve 206 to move into a position to allow the pump 204 to pump outside water 216 into the starboard ballast tank 202. Alternatively, the controller 98 may signal the valve 206 to allow the pump 204 to pump water out of the port ballast tank 200 to the outside water 216. Additional combinations of valve positions and the direction of flow of water into and out of the ballast tanks 200, 202 are possible.

Figure 15:
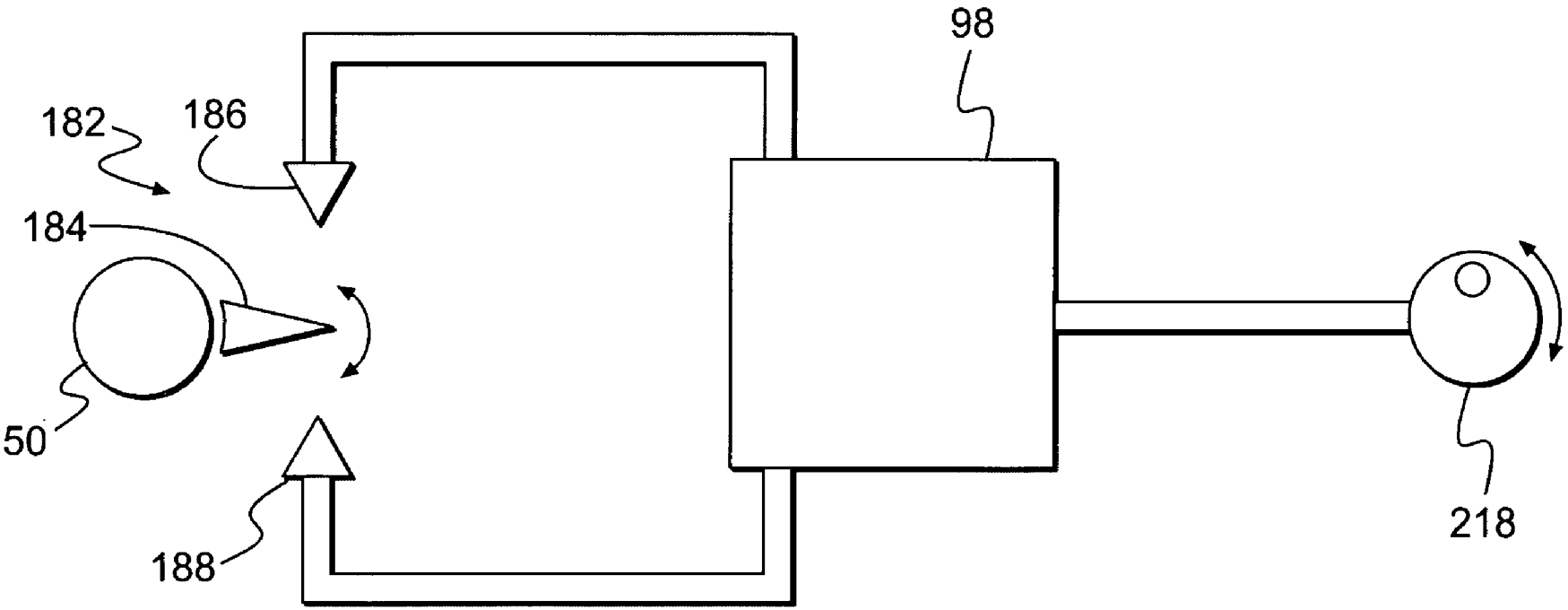
FIG. 15 is a schematic of a nozzle compensation system of the watercraft.
Figure 16:
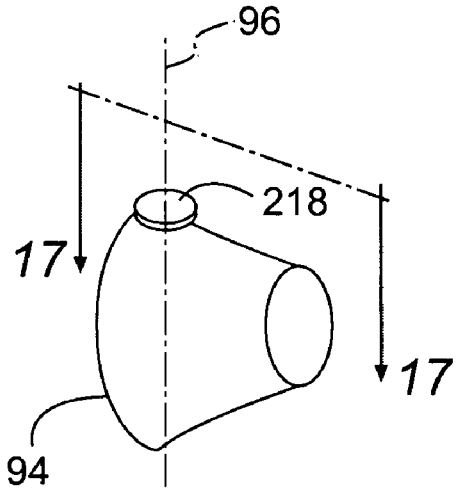
FIG. 16 is a perspective view of the nozzle of the watercraft when a pulling force is not being exerted on the watercraft.
Figure 17:
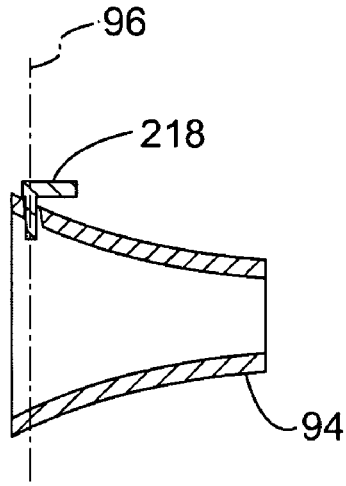
FIG. 17 is a cross-sectional view of the nozzle of FIG. 16.
Figure 18:
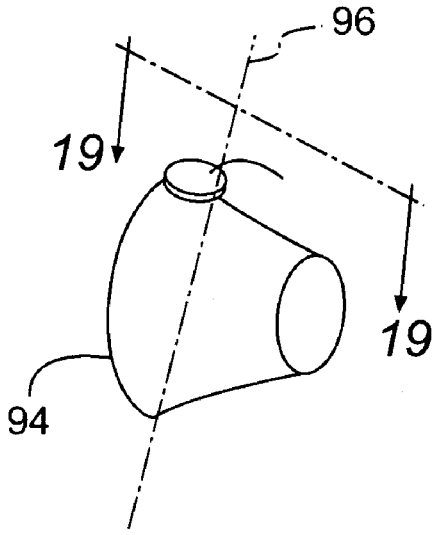
FIG. 18 is a perspective view of the nozzle of the watercraft when a pulling force is being exerted on the watercraft.
Figure 19:
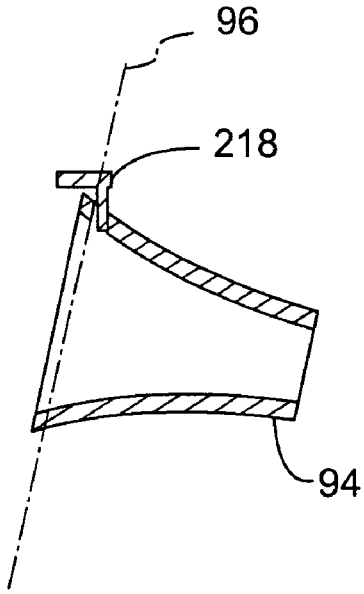
FIG. 19 is a cross-sectional view of the nozzle of FIG. 18.

FIG. 15 illustrates another compensation system for the PWC 10. The compensation system illustrated in FIG. 15 includes the same tow pole 50 and sensor 182 that are shown in FIGS. 13 and 14. However, upon receiving a signal from either the starboard switch 186 or port switch 188, the controller 98 signals a motor 218 to rotate in the appropriate direction. As shown in FIGS. 16–19, the motor 218 is operatively connected to the nozzle 94 such that the axis 96 about which the nozzle 94 rotates is adjusted so as to tilt the nozzle 94 in a downward direction. FIGS. 16 and 17 illustrate the nozzle 94 in the "normal" operating orientation. FIGS. 18 and 19 illustrate the nozzle 94 in the "towing" operating orientation after the controller 98 has signaled the motor 218 to rotate such that the axis 96 about which the nozzle 94 rotates is altered. Such an orientation of the nozzle 94 will generate a downward thrust that will help counter the effect of the force being exerted on the PWC 10 by a skier and thereby help compensate for rotation about at least the roll axis. Preferably, the motor 218 is a step motor, but it is understood that the motor 218 may be any device that allows the axis 96 about which the nozzle 94 rotates to be altered.

For each of the embodiments of the tow pole 42, 44, 46, 48, 50 illustrated in FIGS. 6–15, the tow pole 42, 44, 46, 48, 50 may further include a biasing mechanism (not shown) such as a spring or the like. The biasing mechanism may be connected to the tow pole 42, 44, 46, 48, 50 is any known way such that the biasing mechanism biases the tow pole 42, 44, 46, 48, 50 to a position whereby the guide posts 130

(FIGS. 6 and 7), the tow rope hook 146, 240 (FIGS. 8, 10, and 11), the bracket 180 (FIG. 12), and the indicator 184 (FIGS. 13–15) are substantially aligned with the longitudinal centerline of the PWC 10. This way, if a water skier that is being pulled releases the tow rope, the tow pole 42, 44, 46, 48, 50 will return to a substantially "centered" position.

Figure 20:
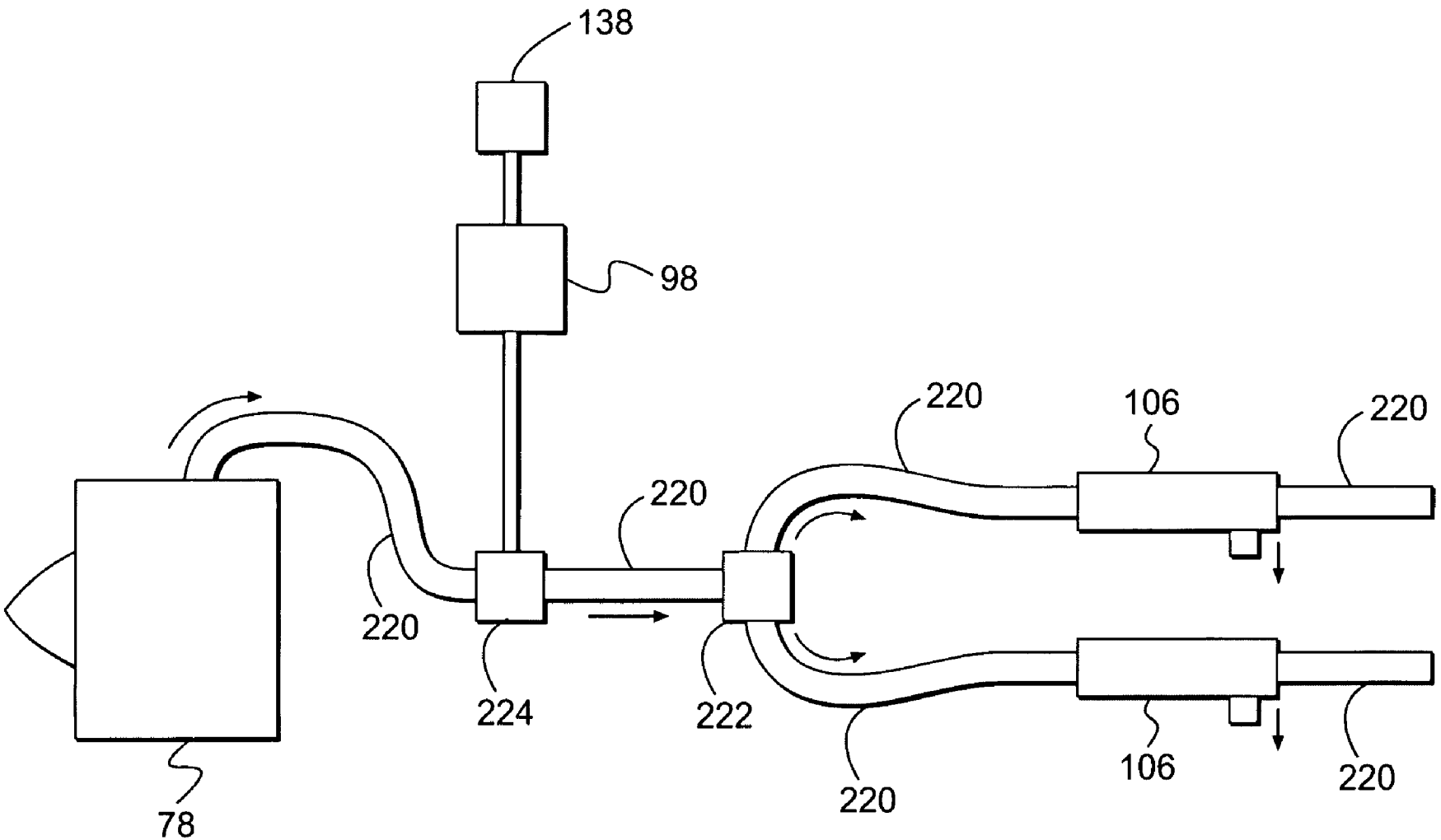
FIG. 20 is a schematic of the off-power steering system of the watercraft.

FIG. 20 illustrates another compensation system, the off power steering system, for the PWC 10. During normal operation, water flows through the jet propulsion system 78 and into pipes or tubes 220 that are a part of the off power steering system. Water flow is split at a T-valve 222 and continues to flow through tubes 220 and into the vanes 106, thereby keeping the vanes 106 in an upward or disengaged position. When there is not enough water flow through the jet propulsion system 78, water does not enter the tubes 220, thereby causing the vanes 106 to lower by the gravitational force into the engaged position.

In this embodiment, a valve 224 is disposed within the tubes 220 in between the jet propulsion system 78 and the T-valve 222. The valve 224 is in communication with the controller 98. When the controller 98 receives a signal from, in this example, sensor 138, indicating that the force being exerted on the PWC is at an angle relative to the longitudinal axis of the PWC 10, the controller 98 may direct the valve 224 to close, thereby stopping the flow of water to the vanes 106. As a result, the vanes 106 will lower into their engaged position. Actuation of the vanes 106 into the engaged position affects the rotation of the PWC 10 about the yaw axis, thereby providing additional steering control to the driver. It is contemplated that any one of the sensor configurations discussed above and illustrated in FIGS. 4–15 may be used to signal the controller 98 to communicate with the valve 224. Alternatively, a pair of valves may be disposed within the tubes 220 between the T-valve 222 and the vanes 106 such that the vanes 106 may be operated independently of one another.

Figure 21:
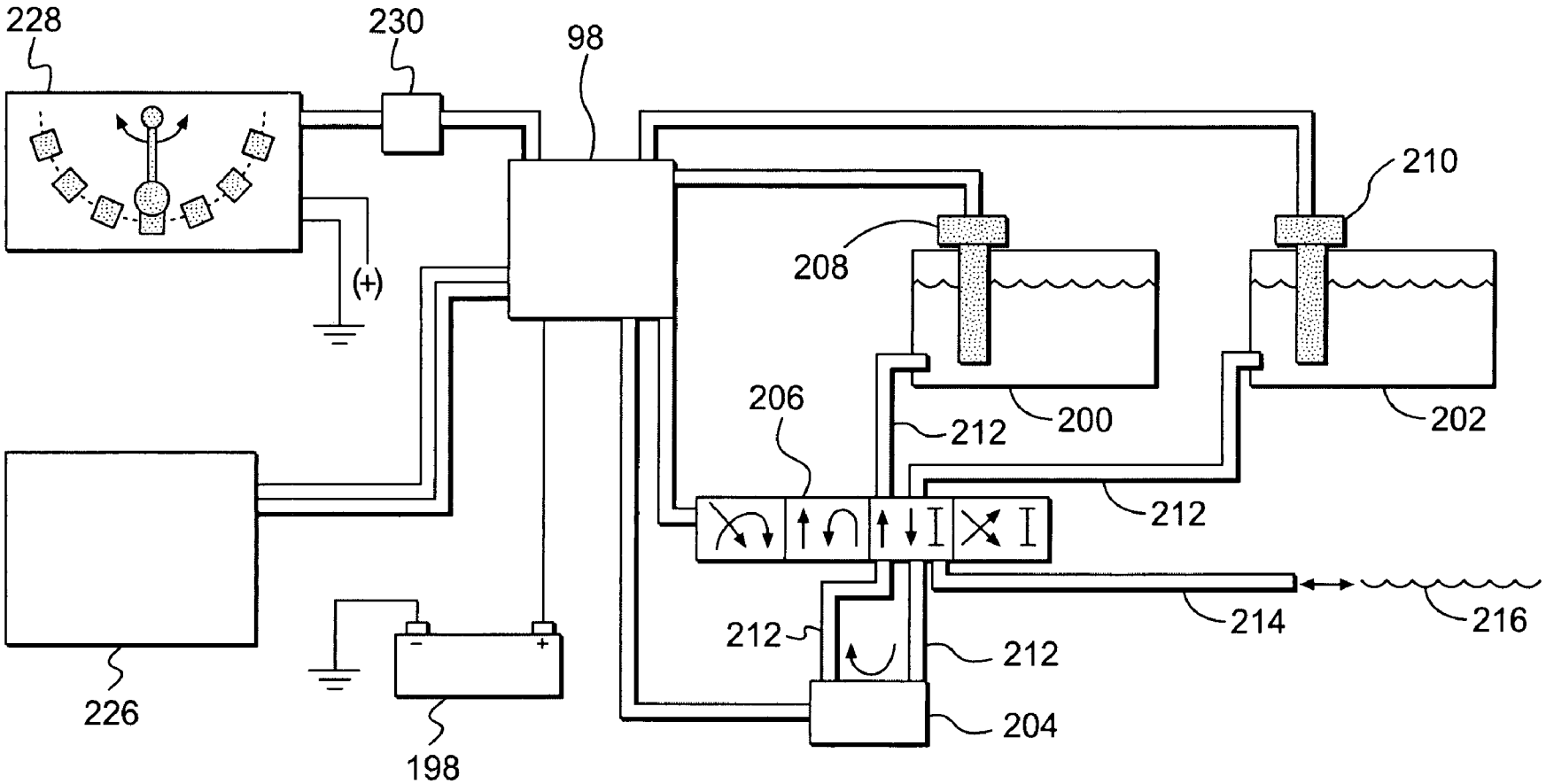
FIG. 21 is a schematic of an alternative water ballast system of FIG. 14.

In another embodiment, the compensation system of FIG. 14 may be used to level the PWC 10 even when the PWC 10 is either idling or in a power-off state. As shown in FIG. 21, the controller 98 is in communication with an engine speed sensor 226 and a level sensor 228. The signal from the level sensor 228 may pass through a signal averaging circuit 230 to take into account movement due to waves and other natural forces being exerted on the PWC 10. It is contemplated that the level sensor 228 may include a pendulum-type device that senses when the center of gravity of the PWC 10 is being altered by an external force such as a person stepping on one side of the deck 14 or when there is an uneven weight distribution on the PWC 10. Such a situation will cause the PWC 10 to tip towards the side where the person is stepping or where the extra weight is located and the level sensor 228 will signal the controller 98 that an adjustment to the ballasts 200, 202 should be made to compensate. Water may then be pumped into and out of the appropriate tank 200, 202 by the pump 204 until the PWC 10 is substantially level again. The controller 98 may be configured such that a signal from the level sensor 228 will only be taken into consideration if the controller 98 determines that the PWC 10 is not moving, i.e. the PWC 10 is idling or is in the power-off position. Also, the controller 98 may be configured to allow the rider to "lock" the compensation system in place such that as the weight distribution changes, the compensation system will not make any adjustments.

As discussed above, the controller 98 is configured to communicate with different sensors and is configured to send a signal to at least one compensation system so as to alter at least one performance parameter of the PWC 10. The performance parameters of the PWC include, but are not limited to, the speed of the PWC, the steering heading of the PWC, and the PWC's rotation about the pitch axis, the roll axis and the yaw axis. The compensation systems of the PWC include the trim tabs 66, the vanes 106, the center of gravity of the PWC 10, the nozzle 94, and the throttle.

Figure 22:
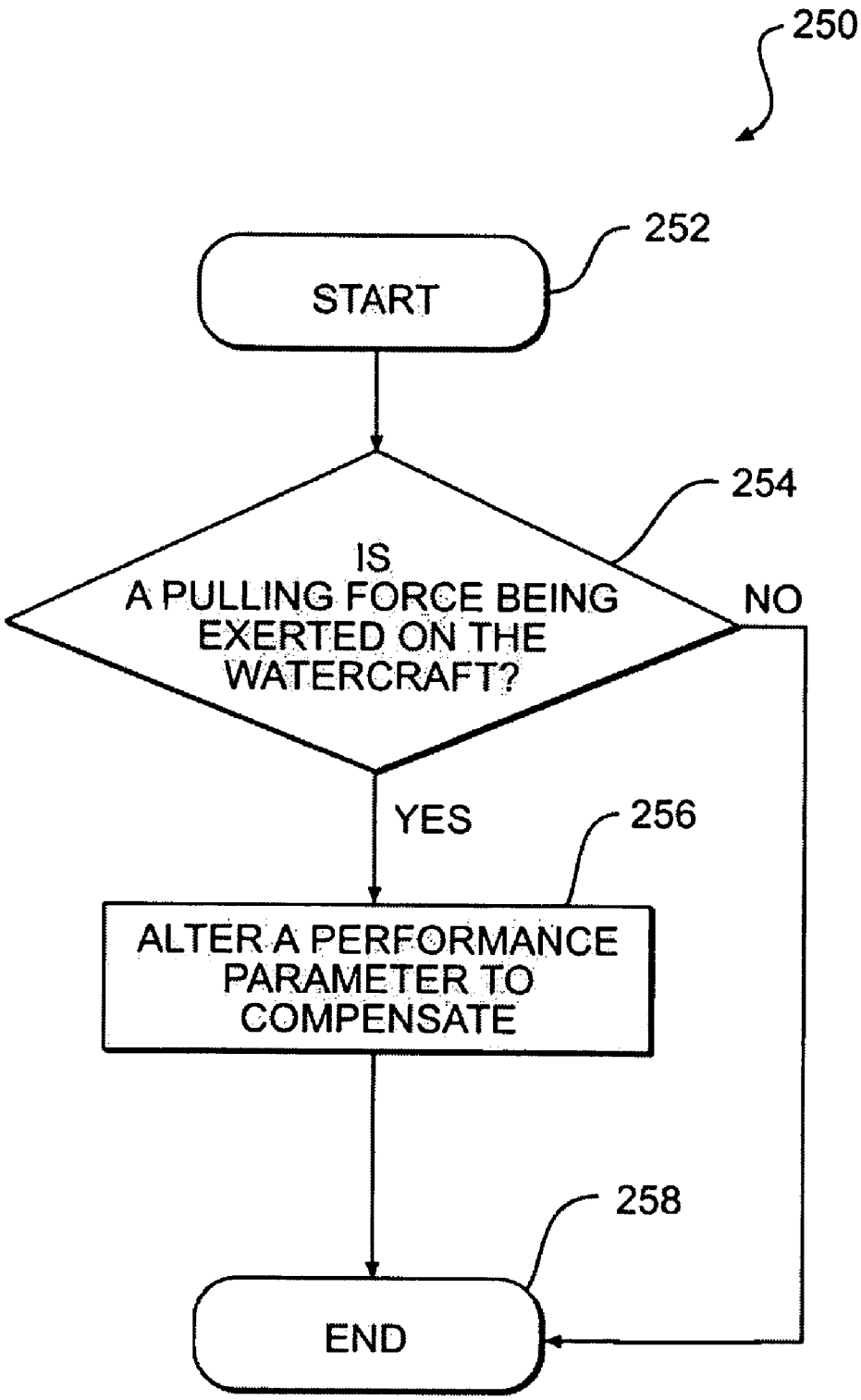
FIG. 22 is a flow chart of one embodiment of a compensation method of the present invention.

FIG. 22 illustrates a compensation method 250, that is performed by the controller 98, for controlling at least one performance parameter of the PWC 10. Control starts at 252. At 254, the controller 98 determines whether there is a pulling force being exerted on the PWC 10. If the controller 98 determines that there is a pulling force being exerted on the PWC 10, the controller 98 will signal a compensation system at 256 to alter a performance parameter to compensate for the force. Control then ends at 258. If the controller 98 determines that there is no pulling force being exerted on the PWC 10, the method ends at 258.

Figure 23:
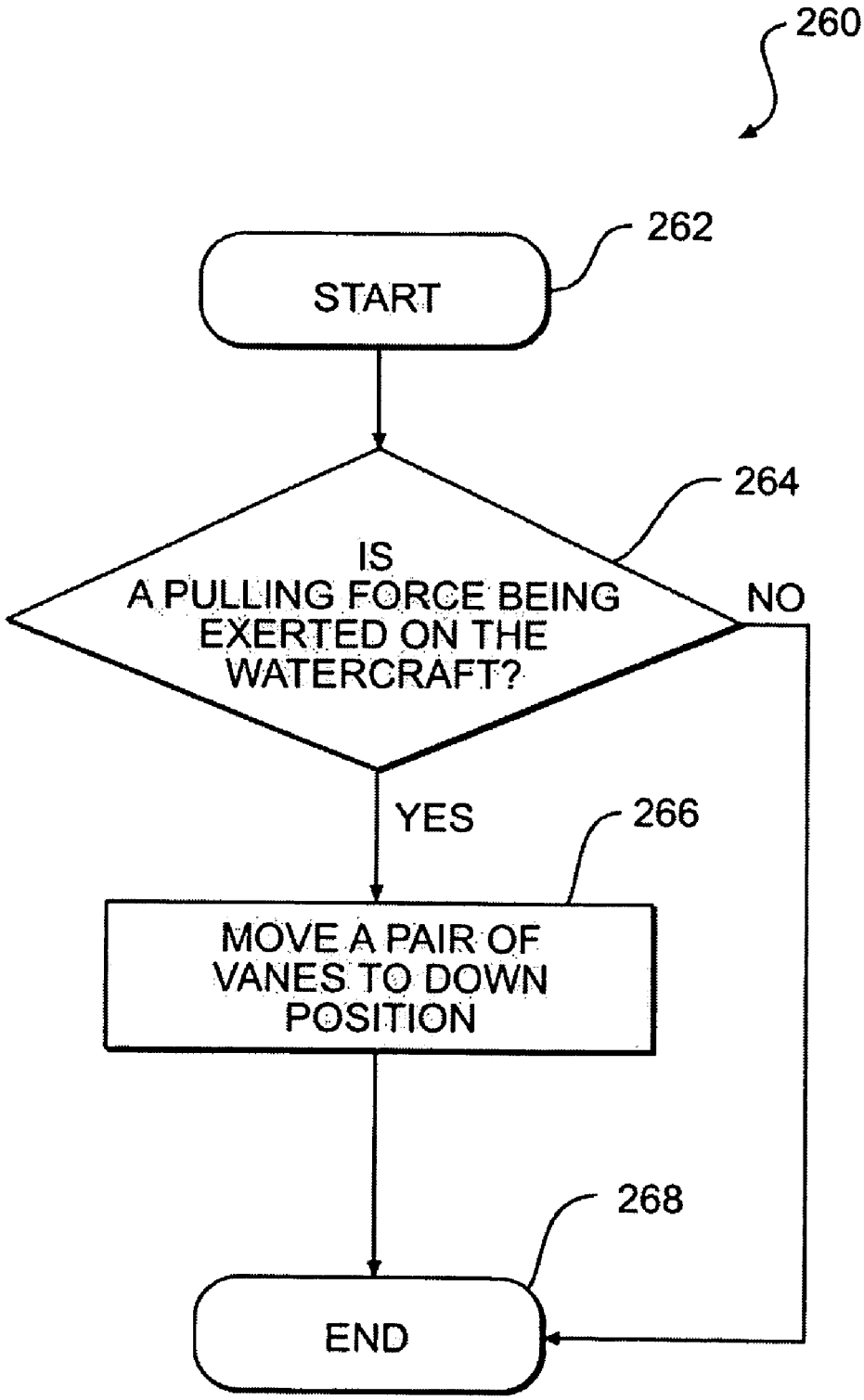
FIG. 23 is a flow chart of another embodiment of the compensation method of the present invention.

FIG. 23 shows an example of a more specific compensation method 260 that is performed by the controller 98 to compensate for external forces being exerted on the PWC 10. Control starts at 262. At 264, the controller 98 determines whether there is a pulling force being exerted on the PWC 10. If the controller 98 determines that there is a pulling force being exerted on the PWC 10, the controller 98 will output the appropriate signal at 266 to move the pair of vanes 106 to the down or engaged position. Thus, referring back to FIG. 20, the controller 98 will signal the valve 224 to close so that water will not flow to the vanes 106, thereby causing the vanes to engage in the down position. Returning to FIG. 23, after the vanes 106 are moved to the down position, control ends at 268. Similar to the control scheme 250 illustrated by FIG. 22, if the controller 98 determines that there is no pulling force being exerted on the PWC 10, control will end at 268.

Figure 24:
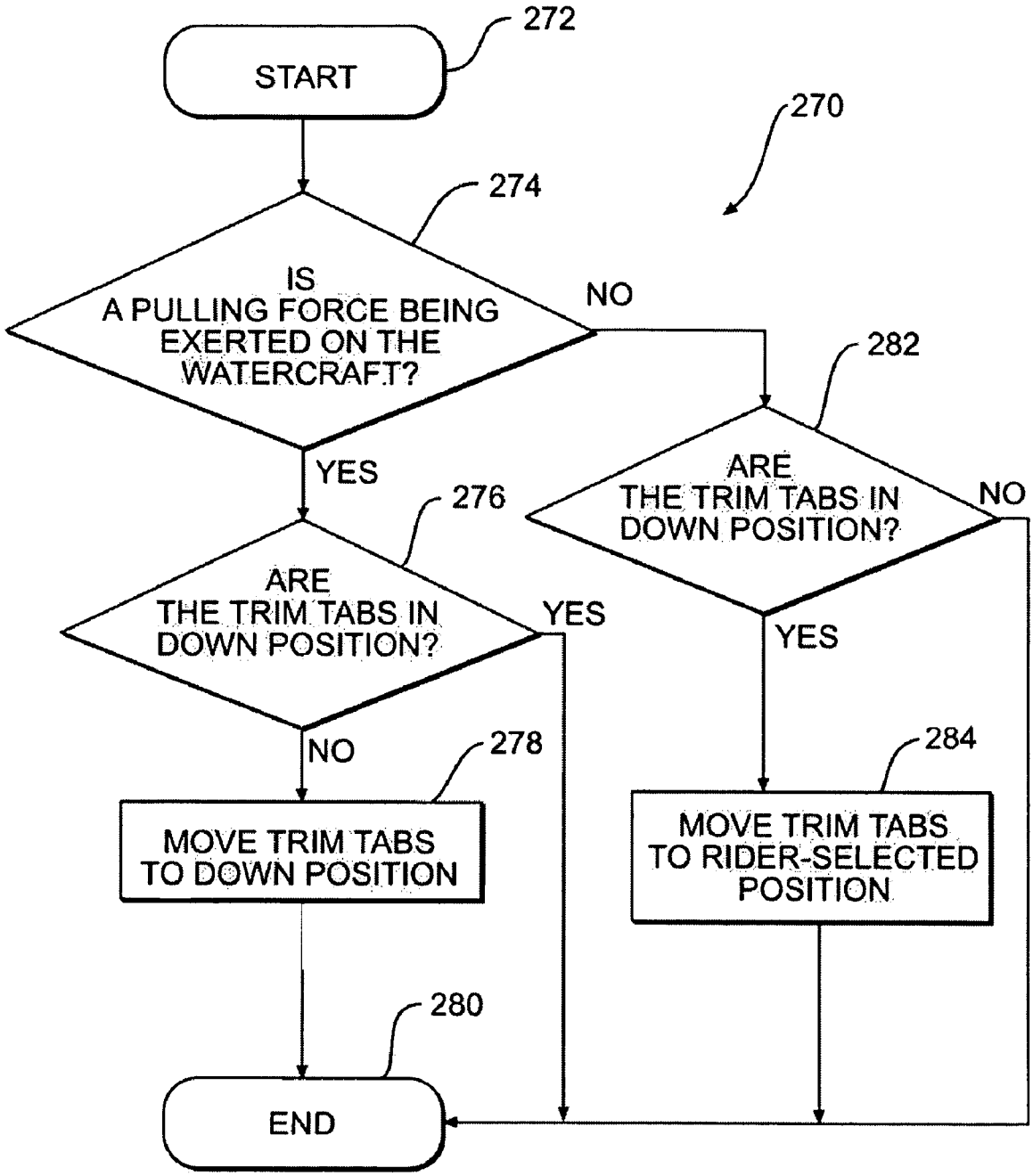
FIG. 24 is a flow chart of another embodiment of the compensation method of the present invention.

FIG. 24 is a compensation method 270 performed by the controller 98 for the trim tabs 66. Control starts at 272. The controller 98 determines whether a pulling force is being exerted on the PWC 10 at 274. If there is a pulling force being exerted on the PWC 10, the controller 98 determines whether the trim tabs 66 are already in a down position at 276. If the trim tabs 66 are not in a down position, the controller 98 generates a signal to direct the trim tabs 66 to be moved to a down position at 278. Control then ends at 280. If there is a pulling force being exerted on the PWC 10 and the trim tabs 66 are already in the down position, control ends at 280. If the controller 98 determines that there is no pulling force being exerted on the PWC 10, the controller 98 may still determine whether the trim tabs 66 are already in the down position at 282. If the trim tabs 66 are in the down position, the controller 98 generates a signal to direct the trim tabs 66 to be moved to a rider-selected position at 284. If the controller 98 determines that the trim tabs 66 are not in the down position, control ends at 280.

Figure 25:
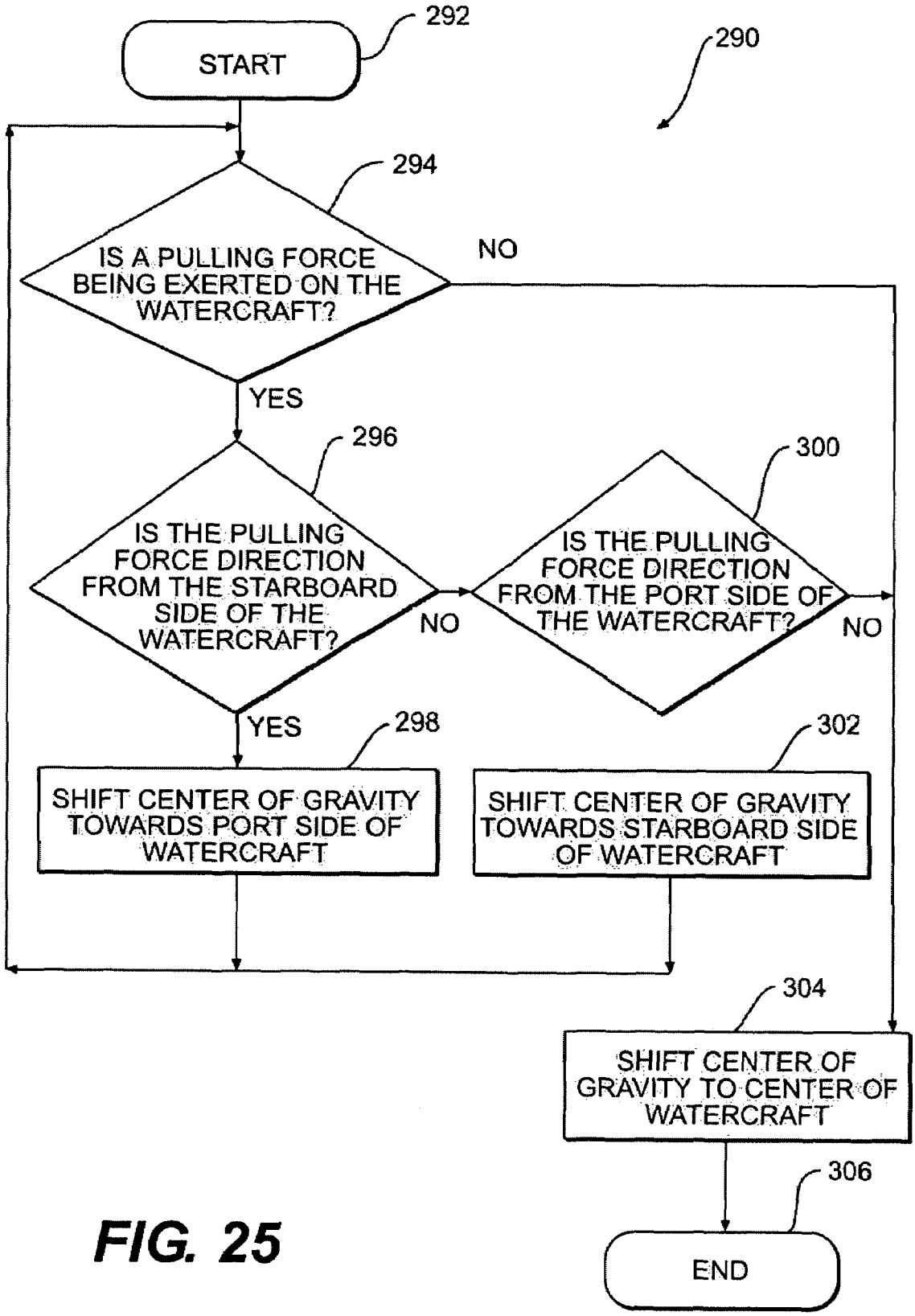
FIG. 25 is a flow chart of another embodiment of the compensation method of the present invention.

The center of gravity of the PWC 10 may be controlled by the controller 98 in a manner consistent with a control scheme 290 illustrated in FIG. 25. In the control scheme 290 shown in FIG. 25, control starts at 292. The controller 98 determines if a pulling force is being exerted on the PWC at 294. If a pulling force is present, the controller 98 next determines if the direction of the pulling force is from the starboard side of the PWC 10 at 296. If the controller 98 determines that the direction of the pulling force is from the starboard side of the PWC 10, the controller 98 signals the appropriate compensation system (e.g. the weight system shown in FIG. 13 or the ballast system shown in FIG. 14) to shift the center of gravity towards the port side of the PWC 10 at 298. If the direction of the pulling force is not from the starboard side, the controller 98 determines whether the direction of the pulling force is from the port side of the PWC 10 at 300. If the direction of the pulling force is from the port side of the PWC 10, the controller 98 signals the appropriate compensation system to shift the center of gravity towards the starboard side of the PWC 10 at 302. If the controller 98 determines that there is no pulling force being exerted on the PWC 10 or that the direction of the pulling force is neither from the starboard nor the port side of the PWC 10, i.e. the direction of the pulling force is along the longitudinal axis of the PWC 10, the controller 98 signals the appropriate compensation device to shift the center of gravity to the center of the PWC 10 at 304. Control then ends at 306.

Figure 26:
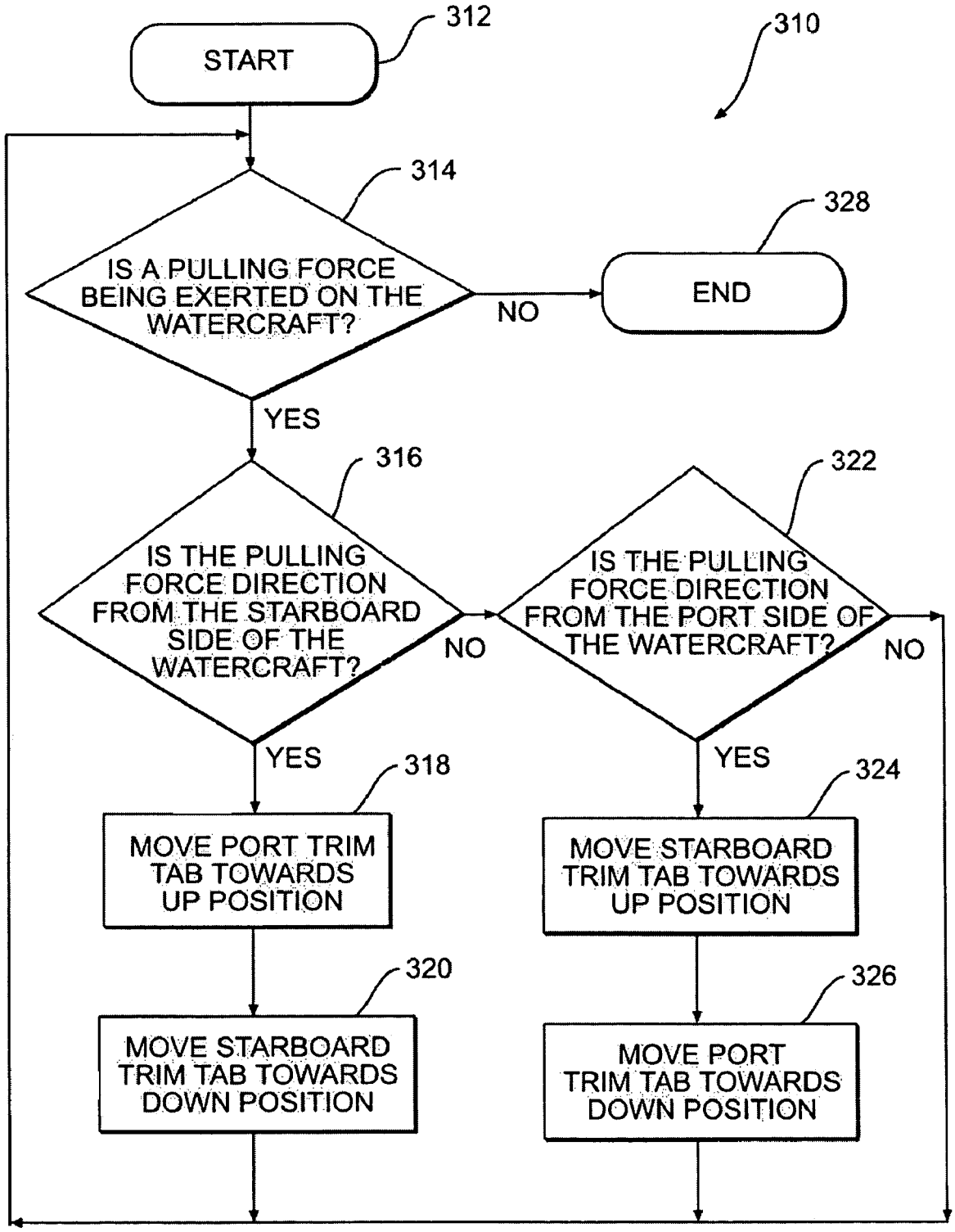
FIG. 26 is a flow chart of another embodiment of the compensation method of the present invention.

Another embodiment for a compensation method 310 for actuating the trim tabs 66 of the PWC 10 is illustrated in FIG. 26. In this embodiment, control starts at 312. The controller 98 determines whether there is a pulling force being exerted on the PWC 10 at 314. If a pulling force is detected, the controller 98 then determines whether the direction of the pulling force is from the starboard side of the PWC 10 at 316. If the controller 98 determines that the direction of the pulling force is from the starboard side of the PWC 10, the controller 98 signals the port trim tab to move towards the up position at 318 and also signals the starboard trim tab to move towards the down position at 320. If the direction of the pulling force is not from the starboard side, the controller 98 determines whether the direction of the pulling force is from the port side of the PWC 10 at 322. If the direction of the pulling force is from the port side of the PWC 10, the controller 98 signals the starboard trim tab to move towards the up position at 324 and also signals the port trim tab to move towards the down position at 326. If the controller 98 determines that the direction of the pulling force is neither from the starboard nor the port side of the PWC 10, i.e. the direction of the pulling force is along the longitudinal axis of the PWC 10, the controller 98 does not signal either of the trim tabs 66 to move. Instead, control returns to 314 so that the controller 98 can determine whether a pulling force is still being exerted on the PWC 10. If the controller determines that there is no pulling force being exerted on the PWC at 314, control ends at 328.

Figure 27:
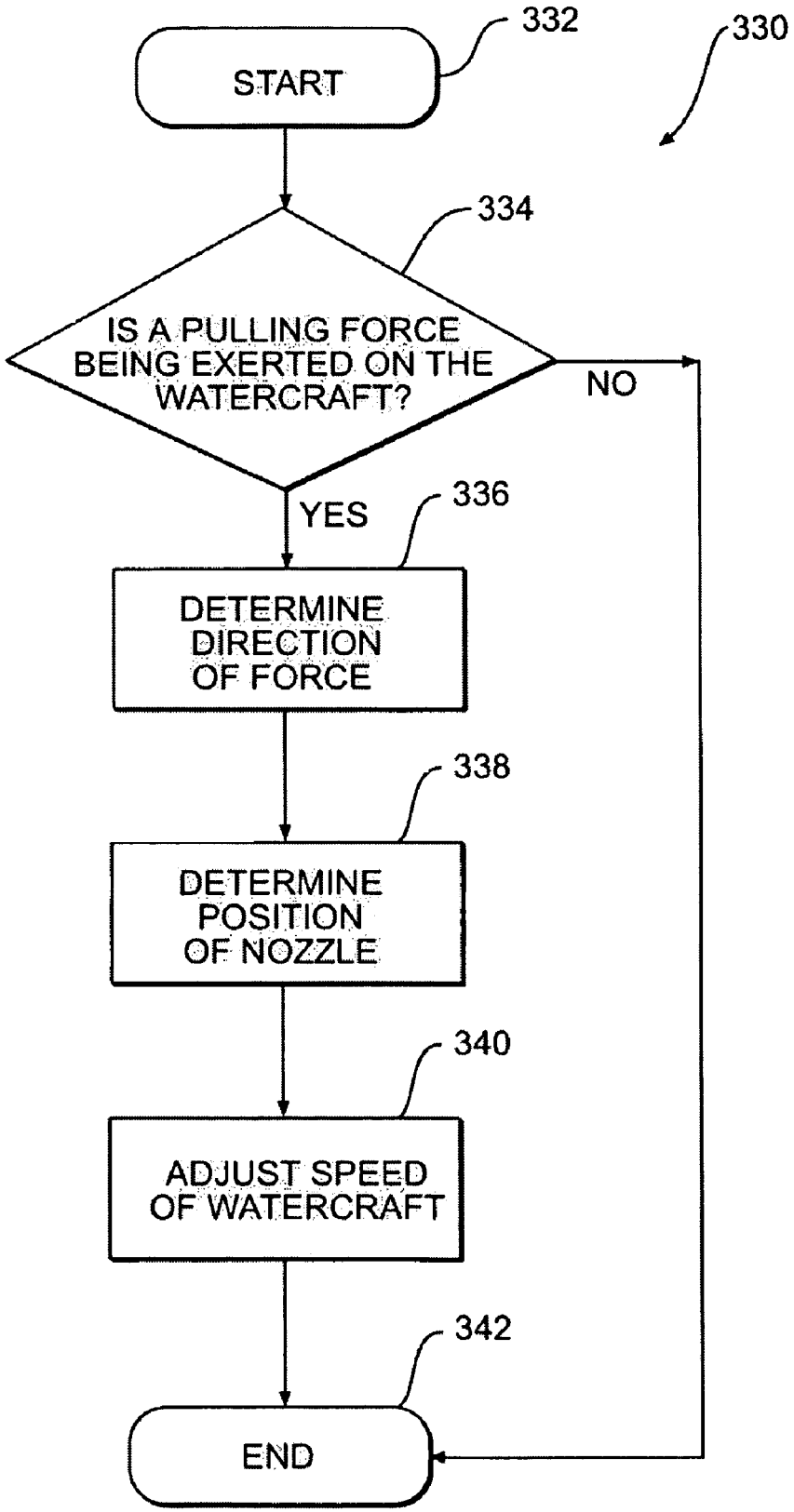
FIG. 27 is a flow chart of another embodiment of the compensation method of the present invention.

FIG. 27 illustrates a compensation method 330 for the controller 28 to adjust at least the pitch of the PWC 10. As shown in FIG. 27, control starts at 332. The controller 98 determines whether there is a pulling force being exerted on the PWC 10 at 334. If the controller 98 determines that there is a pulling force present, control proceeds to 336 where the controller 98 determines the direction of the force. The controller 98 then determines the position of the nozzle 94 at 338. Based on the direction of the force and the position of the nozzle 94, the controller 98 sends a signal to adjust the speed of the PWC 10 to a predetermined level at 340. Control then ends at 342.

It is understood that for each of the compensation methods 290, 310, 330, 350 illustrated in FIGS. 25–28, the controller 98 does not necessarily have to first determine whether there is a pulling force being exerted on the PWC 10, as shown at 294, 314, 334, and 354, respectively. That is, the controller 98 may be configured to determine whether the tow pole or a portion of the tow pole is rotating such that control of the compensation system is based on the rotation rather that the presence of a pulling force. Such control is within the scope of the invention.

Figure 28:
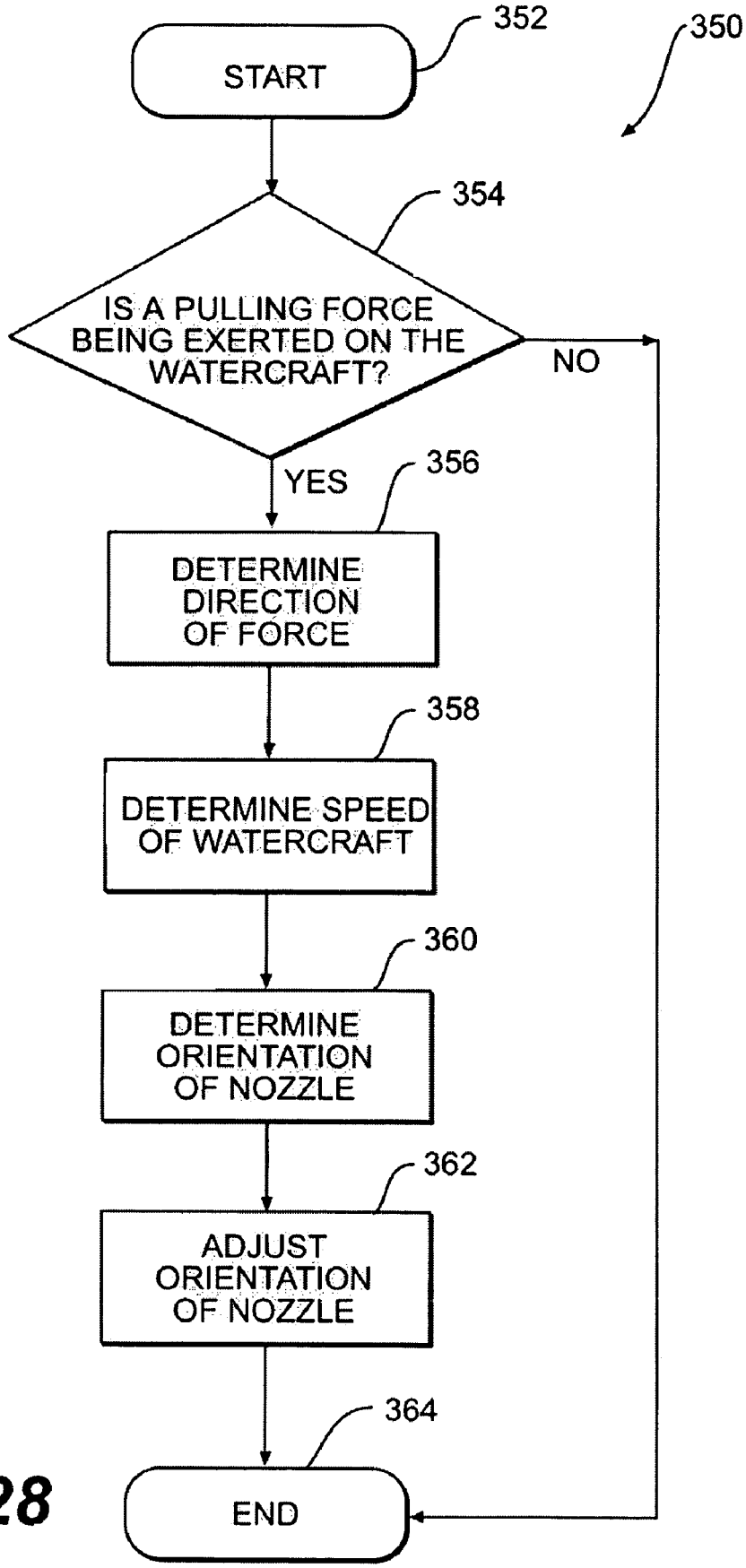
FIG. 28 is a flow chart of another embodiment of the compensation method of the present invention.

Another compensation method 350 for the controller 98 to adjust at least the pitch of the PWC is illustrated in FIG. 28. Control starts at 352. At 354, the controller 98 determines whether there is a pulling force being exerted on the PWC 10. If the controller 98 determines that there is a pulling force present, control proceeds to 356 where the controller 98 determines the direction of the force. The controller 98 next determines the speed of the PWC 10 at 358. The controller 98 then determines the orientation of the nozzle 94 at 360. Based on the direction of the force, the speed of the PWC 10 and the orientation of the nozzle 94, the controller 98 sends a signal to adjust the orientation of the nozzle 94 to a predetermined position at 362. Control then ends at 364.

Figure 29:
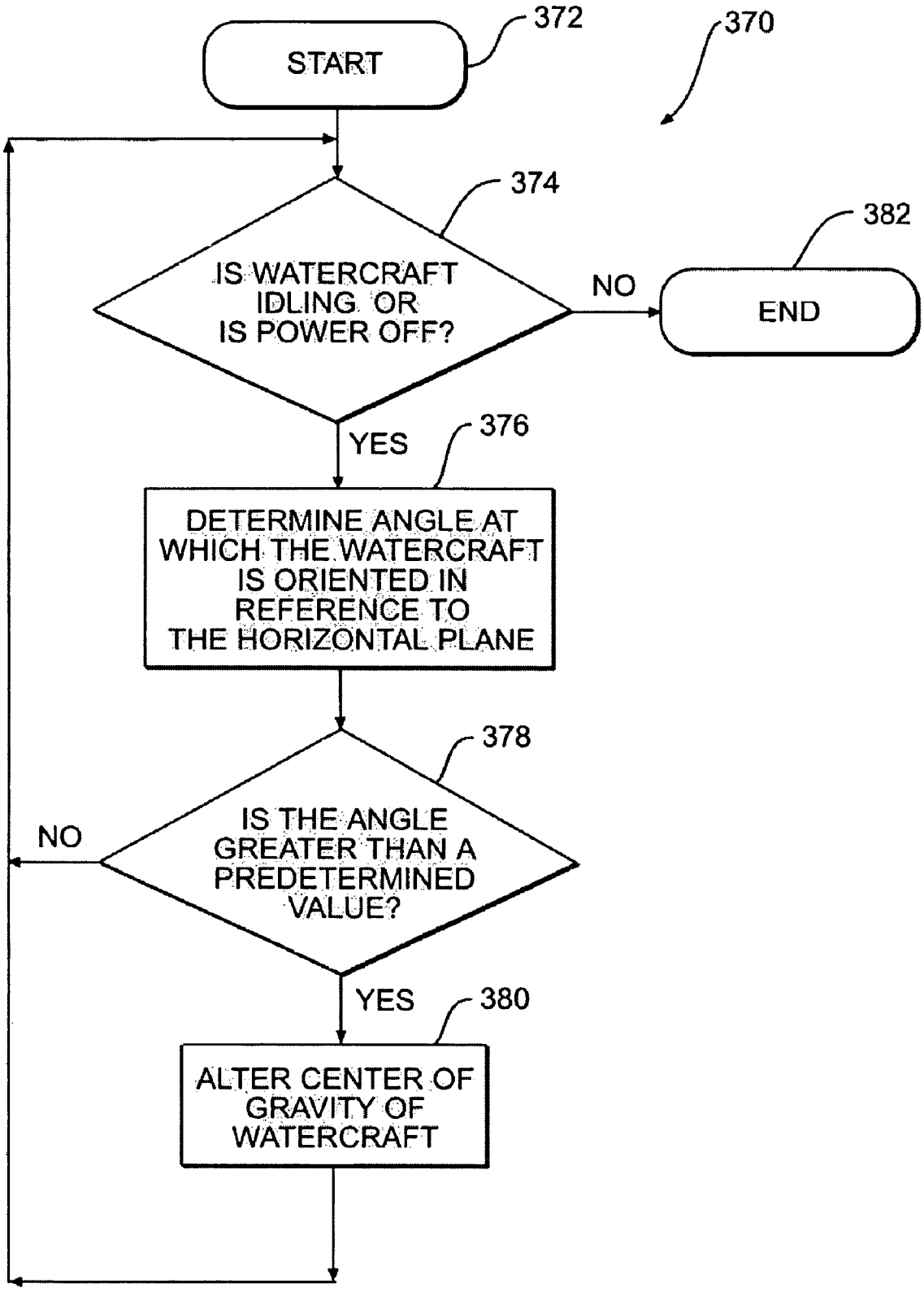
FIG. 29 is a flow chart of another embodiment of the compensation method of the present invention.

A compensation method 370 that may be used in conjunction with the embodiment of the compensation system illustrated in FIG. 21, is shown in FIG. 29. There, control starts at 372. The controller 98 determines whether the PWC 10 is idling or in the power-off state at 374. If the controller 98 determines that the PWC 10 is idling or is in the power-off state, the controller 98 determines the angle at which the PWC 10 is oriented relative to the horizontal plane at 376. The controller 98 then determines whether the angle determined at 376 is greater than a predetermined value at 378. If the angle determined at 376 is greater than a predetermined value, the controller 98 alters the center of gravity of the PWC 10 accordingly at 380. Control then returns to 374. If the controller 98 determines that the PWC 10 is not idling or is not powered off, control ends at 382.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A watercraft comprising:
- a hull having port and starboard sides and a stem;
- a deck supported by the hull;
- a propulsion system mounted to at least one of the hull and the deck;
- a helm connected to the deck and configured to control the direction of the watercraft;
- a pole mounted to the deck;
- a compensation device operatively connected to at least one of the deck and the hull;
- a controller in communication with the compensation device; and
- a sensor operatively connected to the pole and in communication with the controller,
- the sensor being configured to sense a direction of a pulling force exerted on the pole and communicate a signal regarding the direction of the force to the controller,
- the controller being configured to send a signal to the compensation device based on the signal from the sensor to reposition the watercraft.

2. The watercraft of claim 1, wherein the controller is configured to send a signal to the compensation device based on the signal from the sensor and on a magnitude of the pulling force exerted on the pole to reposition the watercraft.

3. The watercraft of claim 2, the compensation device including a starboard vane operatively connected to the starboard side of the hull and a port vane operatively connected to the port side of the hull, wherein the vanes are selectively movable in response to the signal from the controller.

4. The watercraft of claim 2, the compensation device including a starboard trim tab and a port trim tab operatively connected to the stern and in communication with the controller, wherein the trim tabs are selectively movable in response to the signal from the controller.

5. The watercraft of claim 2, the pole including an upper portion and a lower portion, the upper portion being rotatably mounted to the lower portion.

6. The watercraft of claim 2, at least a portion of the pole being rotatable about the longitudinal axis of the pole, the sensor being configured to sense a direction of the rotation of the portion of the pole and communicate a signal regarding the direction to the controller, the controller being configured to send a signal to the compensation device based on the signal from the sensor to reposition the watercraft.

7. The watercraft of claim 2, the compensation device including a motor in communication with the controller;

a support operatively connected to the motor; and a sliding mass disposed on the support, the motor being configured to move the support upon receiving the signal from the controller such that the sliding mass moves to reposition the watercraft.

8. The watercraft of claim 2, further comprising a starboard ballast tank disposed in the starboard side of the hull; and a port ballast tank disposed in the port side of the hull;

the compensation system including a starboard level sensor in fluid communication with the starboard ballast tank and in electrical communication with the controller:

a port level sensor in fluid communication with the port ballast tank and in electrical communication with the controller;

a valve in electrical communication with the controller and in fluid communication with the starboard ballast tank and the port ballast tank; and a pump in electrical communication with the controller and in fluid communication with the valve, the valve being configured to allow water to flow into and out of at least one of the tanks based on the signal from the controller.

9. The watercraft of claim 2, further comprising a nozzle operatively connected to the propulsion system, the compensation device including a motor operatively connected to the nozzle and in communication with the controller, the motor being configured to alter the orientation of an axis about which the nozzle rotates based on the signal from the controller.

10. The watercraft of claim 6, the sensor being configured to sense the direction of the rotation of the portion of the pole when the direction exceeds a predetermined value.

11. A watercraft comprising:

a hull having port and starboard sides and a stern;

a deck supported by the hull;

a propulsion system mounted to at least one of the hull and the deck;

a helm connected to the deck and configured to control the direction of the watercraft; a pole mounted to the deck, at least a portion of the pole being rotatable about the longitudinal axis of the pole; and a compensation device operatively connected to the pole, the compensation device being actuated to reposition the watercraft when the portion of the pole rotates.

12. The watercraft of claim 11, the compensation device including a starboard trim tab pivotally mounted to the stern and operatively connected to the pole and a port trim tab pivotally mounted to the stern and operatively connected to the pole, such that when the portion of the pole rotates, the trim tabs move in opposite directions.

13. The watercraft of claim 11, the compensation device including a sliding weight system.

14. The watercraft of claim 13, the sliding weight system including a frame disposed perpendicular to a longitudinal centerline of the watercraft and a sliding weight that is supported by the frame and is operatively connected to the pole such that rotation of the portion of the pole causes the sliding weight to slide along the frame.

15. A method for compensating for a pulling force being exerted on a pole mounted on a watercraft comprising:

sensing a pulling force exerted on the watercraft, said force having at least a horizontal component;

sensing a direction of die horizontal component of the pulling force; and altering at least one performance parameter of the watercraft based on the pulling force.

16. The compensation method of claim 15, wherein the performance parameter is selected from the group consisting of speed, steering heading, rotation about a roll axis, rotation about a pitch axis, and rotation about a yaw axis.

17. The compensation method of claim 15, wherein altering at least one performance parameter includes moving at least one of a starboard vane operatively connected to the watercraft from one position to another position and a port vane operatively connected to the watercraft from one position to another position.

18. The compensation method of claim 15, wherein altering at least one performance parameter includes moving at least one of a starboard trim tab operatively connected to the watercraft from one position to another position and a port trim tab operatively connected to the watercraft from one position to another position.

19. The compensation method of claim 18, wherein altering at least one trim tab includes moving a first trim tab from one position to another position and moving a second trim tab from one position to another position.

20. The compensation method of claim 15, further comprising sensing a steering angle of the watercraft, wherein altering at least one performance parameter includes adjusting the speed of the watercraft based on the direction of the sensed force and the steering heading of the watercraft.

21. The compensation method of claim 15, further comprising sensing a current steering angle of the watercraft;

sensing a current steering nozzle position; and sensing a current speed of the watercraft, wherein altering at least one performance parameter includes adjusting the steering nozzle position based on the direction of the sensed force, the current speed of the watercraft, the current position of the nozzle, and the current steering angle of the watercraft.

22. The compensation method of claim 20, wherein adjusting the steering nozzle position includes altering an axis about which the steering nozzle rotates such that a downward thrust is generated.

23. A tow pole for a watercraft comprising:

a shaft having at least a portion that is rotatable about the longitudinal axis of the shalt:

a tow rope receiving portion connected to the rotatable portion of the shaft so as to be rotatable therewith; and a sensor, the sensor being positioned to sense rotation of the rotatable portion of the shaft.

24. A watercraft comprising:

a hull having port and starboard sides and a stern;

a deck supported by the hull;

a straddle seat for an operator supported by the deck;

a grab handle connected to at least one of the seat and the deck;

a propulsion system mounted to at least one of the hull and the deck;

a helm including a handle bar connected to the deck and configured to control the direction of the watercraft;

a compensation device operatively connected to at least one of the deck and the hull;

a controller in communication with the compensation device; and a sensor in communication with the controller, the sensor being configured to sense a pulling force and communicate a signal regarding the force to the controller, the controller being configured to send a signal to the compensation device based on the signal from the sensor to reposition the watercraft.

25. The watercraft of claim 24, the compensation device including a motor in communication with the controller;

a support operatively connected to the motor; and a sliding mass disposed on the support, the motor being configured to move the support upon receiving the signal from the controller such that the sliding mass moves to reposition the watercraft.

26. The watercraft of claim 24, further comprising a starboard ballast tank disposed in the starboard side of the hull; and a port ballast tank disposed in the port side of the hull;

the compensation system including a starboard level sensor in fluid communication with the starboard ballast tank and in electrical communication with the controller;

a port level sensor in fluid communication with the port ballast tank and in electrical communication with the controller;

a valve in electrical communication with the controller and in fluid communication with the starboard ballast tank and the port ballast tank; and a pump in electrical communication with the controller and in fluid communication with the valve, the valve being configured to allow water to flow into and out of at least one of the tanks based on the signal from the controller.

27. The watercraft of claim 24, further comprising a nozzle operatively connected to the propulsion system, the compensation device including a motor operatively connected to the nozzle and in communication with the controller, the motor being configured to alter the orientation of an axis about which the nozzle rotates based on the signal from the controller.

28. The watercraft of claim 24, the sensor being configured to sense the direction of the force when the direction exceeds a predetermined value.

29. The watercraft of claim 24, the compensation device further including a starboard vane operatively connected to the starboard side of the hull and a port vane operatively connected to the port side of the hull, wherein the vanes are selectively movable in response to the signal from the controller.

30. The watercraft of claim 24, the compensation device further including a starboard trim tab and a port trim tab operatively connected to the stem and in communication with the controller, wherein the trim tabs are selectively movable in response to the signal from the controller.

* * * * *